US008737867B2

(12) United States Patent
Sato

(10) Patent No.: US 8,737,867 B2
(45) Date of Patent: May 27, 2014

(54) IMAGE FORMING APPARATUS AND CARTRIDGE

(75) Inventor: Shougo Sato, Seto (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 166 days.

(21) Appl. No.: 13/361,858

(22) Filed: Jan. 30, 2012

(65) Prior Publication Data

US 2012/0251160 A1 Oct. 4, 2012

(30) Foreign Application Priority Data

Mar. 31, 2011 (JP) ..... 2011-078854
Mar. 31, 2011 (JP) ..... 2011-078856

(51) Int. Cl.
*G03G 15/16* (2006.01)
*G03G 15/08* (2006.01)
*G03G 15/00* (2006.01)

(52) U.S. Cl.
USPC ..... 399/101; 399/110; 399/120

(58) Field of Classification Search
USPC ..... 399/120
See application file for complete search history.

(56) References Cited

U.S. PATENT DOCUMENTS

| | | | | |
|---|---|---|---|---|
| 2009/0226205 | A1 | 9/2009 | Sato et al. | |
| 2009/0285593 | A1 | 11/2009 | Sakuma | |
| 2009/0317130 | A1 | 12/2009 | Ishikawa et al. | |
| 2010/0028041 | A1 * | 2/2010 | Sakuma | 399/101 |
| 2010/0074646 | A1 | 3/2010 | Miyahara et al. | |
| 2010/0178078 | A1 | 7/2010 | Tamura et al. | |
| 2010/0209157 | A1 | 8/2010 | Sato et al. | |
| 2010/0272467 | A1 | 10/2010 | Sato | |

FOREIGN PATENT DOCUMENTS

| | | | |
|---|---|---|---|
| JP | S61-022370 | A | 1/1986 |
| JP | S64-006990 | A | 1/1989 |
| JP | H04-179975 | A | 6/1992 |
| JP | H05-257340 | A | 10/1993 |
| JP | 2001-051522 | A | 2/2001 |
| JP | 2002-311670 | A | 10/2002 |
| JP | 2009-210937 | A | 9/2009 |
| JP | 2009-276438 | A | 11/2009 |
| JP | 2010-008472 | A | 1/2010 |
| JP | 2010-008512 | A | 1/2010 |

(Continued)

OTHER PUBLICATIONS

Japan Patent Office, Notice of Reasons for Rejection for Japanese Patent Application No. 2011-078856 (counterpart to above-captioned patent application), mailed Apr. 2, 2013.

*Primary Examiner* — Clayton E Laballe
*Assistant Examiner* — Jas Sanghera
(74) *Attorney, Agent, or Firm* — Merchant & Gould P.C.

(57) ABSTRACT

An endless belt confronts the photosensitive drum. A developing unit includes a developer accommodation portion that is configured to accommodate developer, and a developing roller that is rotatably provided and supplies the photosensitive drum with the developer. A collecting unit is configured to remove waste developer to be discarded from the endless belt and to collect the waste developer. A waste developer accommodation portion is provided integrally with the developer accommodation portion and is configured to accommodate the waste developer collected by the collecting unit. A conveying mechanism is configured to be connected to both the waste developer accommodation portion and the collecting unit and to convey the waste developer from the collecting unit to the waste developer accommodation portion. The waste developer accommodation portion is movable relative to the conveying mechanism.

16 Claims, 17 Drawing Sheets

(56) References Cited

FOREIGN PATENT DOCUMENTS

| | | | |
|---|---|---|---|
| JP | 2010-038947 | A | 2/2010 |
| JP | 2010-078848 | A | 4/2010 |
| JP | 2010-164632 | A | 7/2010 |
| JP | 2010-191012 | A | 9/2010 |
| JP | 2010-256827 | A | 11/2010 |
| JP | 2011-017939 | A | 1/2011 |

* cited by examiner

1

IMAGE FORMING APPARATUS AND CARTRIDGE

CROSS REFERENCE TO RELATED APPLICATION

This application claims priorities from Japanese Patent Application Nos. 2011-078856 filed Mar. 31, 2011 and 2011-078854 filed Mar. 31, 2011. The entire content of each of these priority applications is incorporated herein by reference.

TECHNICAL FIELD

The present invention relates to an image forming apparatus such as a color printer.

BACKGROUND

In a conventional color printer, four photosensitive drums each corresponding to one of four colors of yellow, magenta, cyan and black are juxtaposed. Four developing cartridges are provided each for one of the photosensitive drums. Each developing cartridge includes a developing roller for supplying toner to the corresponding photosensitive drum.

For forming a colored image, an electrostatic latent image is formed on each photosensitive drum. The electrostatic latent image is then developed into a visible toner image when toner is supplied thereto from the corresponding developing roller. The toner image is then transferred onto a sheet, which is conveyed by a conveyer belt, either directly or indirectly via an intermediate transfer belt, thereby forming a black-and-white image or a colored image on the sheet.

The toner transferred from the photosensitive drum is deposited on the conveyor belt. A cleaning member is therefore provided for collecting toner from the conveyor belt. The toner collected (removed) from the conveyor belt is conveyed to and stored in a waste toner accommodating unit.

There has been proposed a developing cartridge that is integrally formed with a waste toner accommodating unit. Under this construction, when toner within the developing cartridge is used up and the developing cartridge is replaced with a new developing cartridge, the waste toner accommodating unit is also replaced with a new one that is integrated with the new developing cartridge.

SUMMARY

However, the above-identified structure does not intend to move the developing cartridge that has been mounted in a main casing of an image forming apparatus. Therefore, the mounted developing cartridge remains stationary in the main casing, which means that a developing roller of the mounted developing cartridge is incapable of changing its position. In other words, it is impossible to suitably change the position of the developing roller relative to the corresponding photosensitive drum, nor to separate the developing roller from the photosensitive drum when no toner image is formed thereon in order to suppress deterioration of the developing roller.

In view of the foregoing, it is an object of the present invention to provide an image forming apparatus having a construction that enables a developer accommodating unit and a waste toner accommodating unit integrally formed with each other to be movable in the image forming apparatus.

In order to attain the above and other objects, there is provided an image forming apparatus including a photosensitive drum, an endless belt, a developing unit, a collecting unit, a waste developer accommodation portion, and a conveying mechanism. The endless belt confronts the photosensitive drum. The developing unit includes a developer accommodation portion that is configured to accommodate developer, and a developing roller that is rotatably provided and supplies the photosensitive drum with the developer. The collecting unit is configured to remove waste developer to be discarded from the endless belt and to collect the waste developer. The waste developer accommodation portion is provided integrally with the developer accommodation portion and is configured to accommodate the waste developer collected by the collecting unit. The conveying mechanism is configured to be connected to both the waste developer accommodation portion and the collecting unit and to convey the waste developer from the collecting unit to the waste developer accommodation portion. The waste developer accommodation portion is movable relative to the conveying mechanism.

According to another aspect, there is provided an image forming apparatus including a target member used for waste developer recovery, a developing unit, a collecting unit, a waste developer accommodation portion, and a conveying mechanism. The developing unit includes a developer accommodation portion that is configured to accommodate developer, and a developing roller that is rotatably provided about a rotational axis extending in an axial direction and bears the developer thereon. The developing unit is pivotally movable about a pivotal axis parallel to the rotational axis. The collecting unit is configured to remove waste developer to be discarded from the target member and to collect the waste developer. The waste developer accommodation portion is provided integrally with the developer accommodation portion and configured to accommodate the waste developer collected by the collecting unit. The conveying mechanism is configured to be connected to both the waste developer accommodation portion and the collecting unit and to convey the waste developer from the collecting unit to the waste toner accommodation portion. The waste developer accommodation portion is provided with a connecting portion that is connected to the conveying mechanism to be movable relative to the conveying mechanism.

According to another aspect, there is provided a cartridge configured to be detachably mounted on a developing unit provided on an image forming apparatus. The image forming apparatus includes an endless belt and a collecting unit configured to remove waste developer to be discarded from the endless belt and to collect the waste developer. The cartridge includes a photosensitive drum, a developing unit, a waste developer accommodation portion, and a conveying mechanism. The developing unit includes a developer accommodation portion configured to accommodate developer; a waste developer accommodation portion provided integrally with the developer accommodation portion and configured to accommodate the waste developer collected by the collecting unit; and a conveying mechanism configured to be connected to both the waste developer accommodation portion and the collecting unit and to convey the waste developer from the collecting unit to the waste toner accommodation portion. The waste developer accommodation portion is provided with a connecting portion. The connecting portion is connected to the conveying mechanism to be movable relative to the conveying mechanism such that the connecting portion is rotatable in a state that the developer accommodation portion and the waste developer accommodation portion are mounted on the developing unit.

DETAILED DESCRIPTION

An image forming apparatus according to an embodiment of the present invention will be described while referring to accompanying drawings.

1. General Construction of Color Printer

First, a general construction of a color printer 1 as an example of an image forming apparatus according to an embodiment of the present invention will be described while referring to FIGS. 1 through 4.

In the following description, a left side in FIG. 1 will be referred to as a front side, while a right side in FIG. 1 will be referred to as a rear side. The terms "upward", "downward", "upper", "lower", "above", "below", "beneath", "right", "left", "front", "rear" and the like will be used assuming that the color printer 1 is viewed from its front side. That is, a near side in FIG. 1 will be referenced as a right side, while a far side in FIG. 1 will be referenced as a left side.

The color printer 1 is a tandem color printer. As shown in FIG. 1, the color printer 1 includes a main casing 2. The main casing 2 has a front surface on which a front cover 4 is movably provided so that a user can open and close the same.

Figure 1:
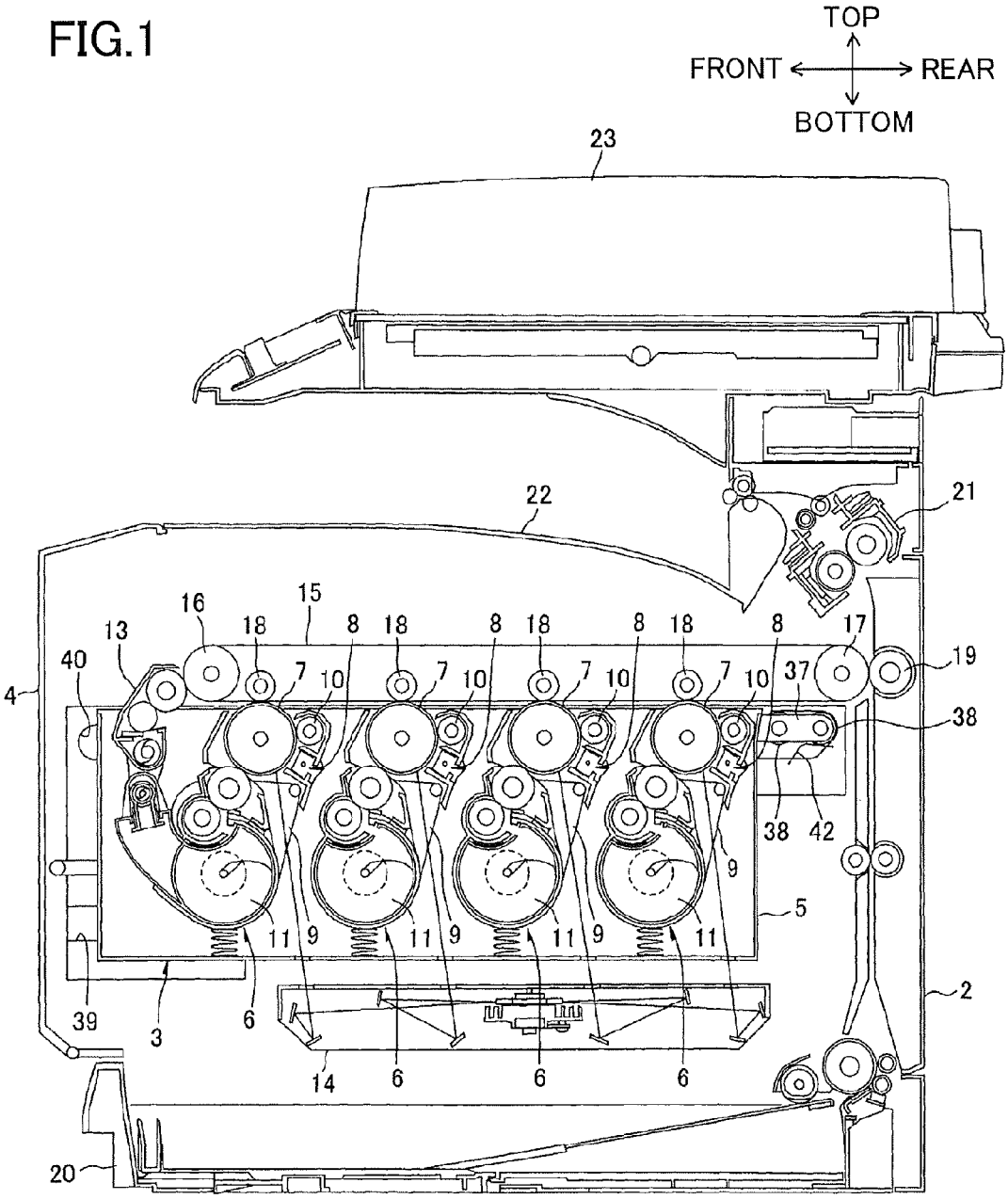
FIG. 1 is a cross-sectional view of a color printer according to an embodiment of the present invention, the color printer accommodating a drawer unit on which developing rollers and photosensitive drums are mounted, wherein each developing roller is in contact with corresponding photosensitive drum.
Figure 2:
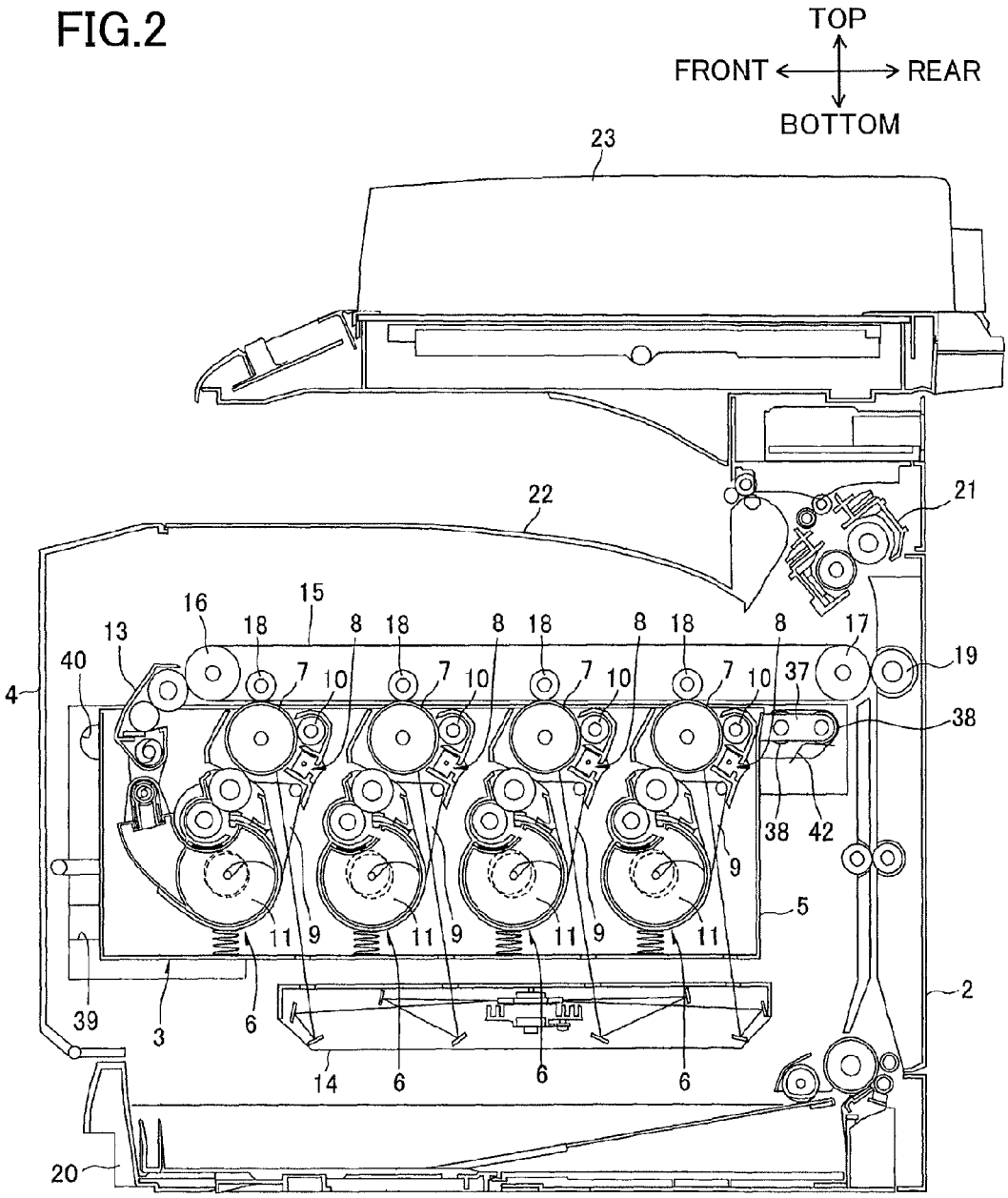
FIG. 2 is a cross-sectional view of the color printer according to the embodiment, wherein each developing roller is in separation from the corresponding photosensitive drum.

Within the main casing 2, a drawer unit 3, an exposing device 14, an intermediate belt 15, a sheet feed cassette 20 and a fixing device 21 are disposed, as shown in FIGS. 1 and 2.

Figure 3:
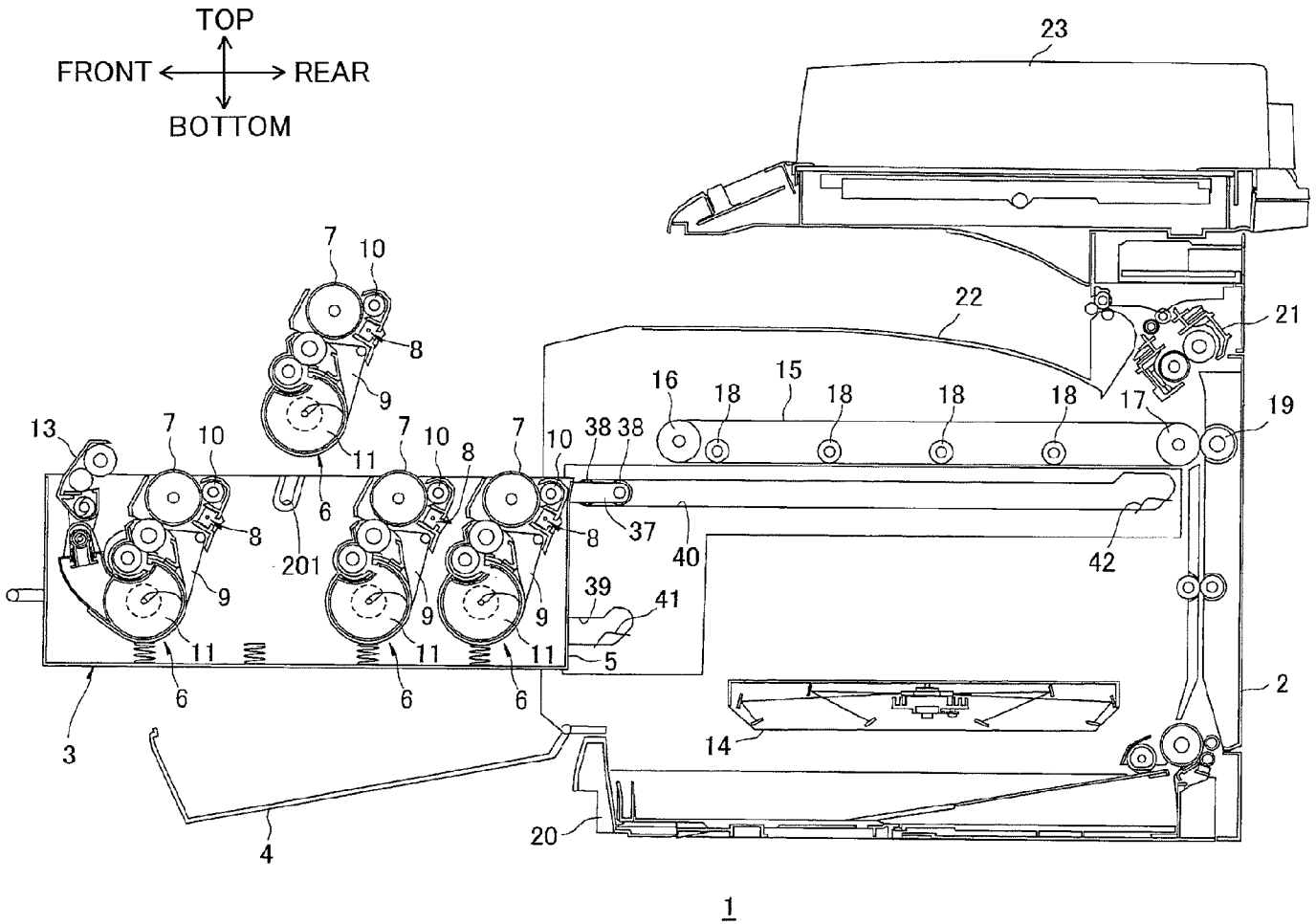
FIG. 3 is a cross-sectional view of the color printer according to the embodiment, wherein the drawer unit is in a pulled-out position and one of process units (a process unit for yellow) is removed from the drawer unit.
Figure 4:
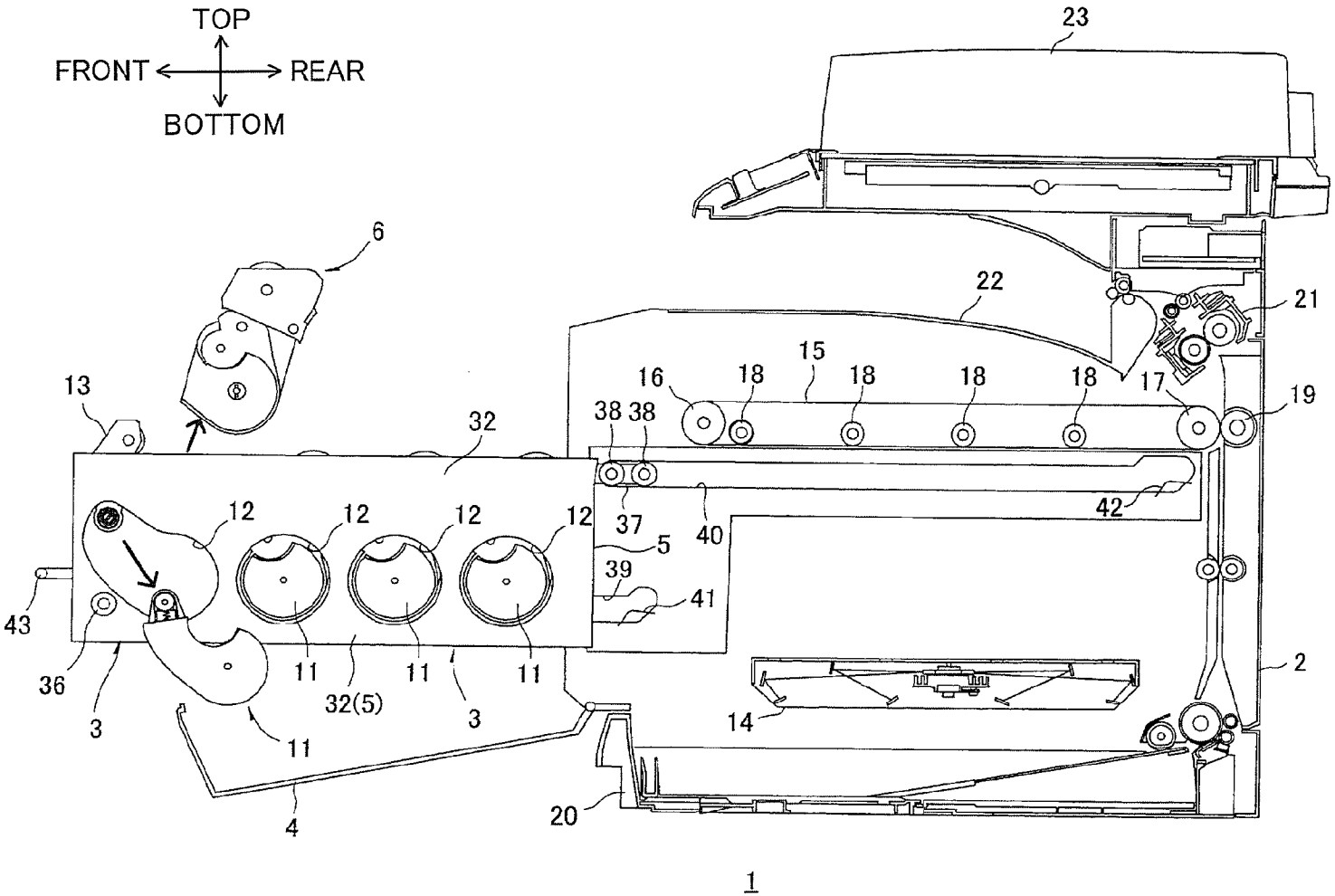
FIG. 4 is a cross-sectional view of the color printer according to the embodiment, wherein the drawer unit is in the pulled-out position and a process unit for black and a toner cartridge for black are respectively taken out from the drawer unit.

When the front cover 4 is opened, the drawer unit 3 is movable in a front-to-rear direction (horizontally) between an accommodated position where the drawer unit 3 is accommodated within the main casing 2 (shown in FIGS. 1 and 2) and a pulled-out position where the drawer unit 3 is pulled out from the main casing 2 (shown in FIGS. 3 and 4). In the pulled-out position, the drawer unit 3 is not completely detached from the main casing 2, but a portion of the drawer unit 3 remains within the main casing 2.

The drawer unit 3 includes a drawer frame 5. Within the drawer frame 5, four process units 6 are supported (retained). The four process units 6 are provided in correspondence with four colors (black, yellow, magenta and cyan) used for the color printer 1, and arranged in the front-to-rear direction in an order mentioned above.

When the drawer unit 3 is in the pulled-out position, each process unit 6 can be detached from and mounted on the drawer frame 5 from above, as shown in FIG. 3.

Each process unit 6 includes a photosensitive drum 7, a charger 8, a developing device 9 and a drum cleaner 10. The photosensitive drum 7 is supported such that the photosensitive drum 7 is rotatable about its axis extending in a left-to-right direction.

The charger 8, the developing device 9 and the drum cleaner 10 are respectively disposed to surround the photosensitive drum 7. More specifically, as shown in FIG. 1, the charger 8 is disposed diagonally downward and rearward of the photosensitive drum 7. The developing device 9 is disposed below the photosensitive drum 7, and the drum cleaner 10 is arranged rearward of the photosensitive drum 7 and above the charger 8.

The developing device 9 has a lower end portion on which a toner cartridge 11 is mounted. The toner cartridge 11 stores therein toner to be supplied to the developing device 9. As shown in FIG. 4, the drawer frame 5 has a right side wall 32 on which four cartridge replacement holes 12 are formed, each cartridge replacement hole 12 corresponding to each process unit 6. Each toner cartridge 11 is detachably mountable on the lower end portion of the corresponding developing device 9 through the cartridge replacement hole 12. Further, as shown in FIG. 3, each of the toner cartridges 11 for yellow, magenta and cyan is detachably mountable on the drawer frame 5 from above, integrally with the corresponding process unit 6, while being mounted on the lower end portion of the corresponding developing device 9.

As shown in FIGS. 1 to 4, the drawer frame 5 has an upper front end portion on which a belt cleaner 13 is disposed.

The exposing device 14 is disposed below the drawer unit 3 disposed at the accommodated position. The exposing device 14 irradiates four laser beams, each laser beam corresponding to one of the four colors and being directed toward the corresponding photosensitive drum 7.

During image formation, each photosensitive drum 7 rotates clockwise in FIG. 1. In accordance with the rotation of the photosensitive drum 7, a surface of the photosensitive drum 7 is uniformly charged by the charger 8 and is then selectively exposed to light by the laser beam emitted from the exposing device 14, thereby forming an electrostatic latent image on the surface of the photosensitive drum 7. The developing device 9 subsequently supplies toner to the electrostatic latent image to develop the same into a visible toner image.

The intermediate belt 15 is disposed above the drawer unit 3 disposed at the accommodated position. The intermediate belt 15 is an endless belt and is mounted on a pair of rollers 16, 17 in a taut state. The rollers 16, 17 are disposed in opposition to each other in the front-to-rear direction and at positions substantially identical to each other in a vertical direction (top-to-bottom direction). In other words, the intermediate belt 15 has a lower portion extending in the front-to-rear direction and in the left-to-right direction between the rollers 16 and 17, the lower portion being in contact with each of the four photosensitive drums 7. Hereinafter, the lower portion of the intermediate belt 15 may also be referred to as a flat-plate portion of the intermediate belt 15, whenever necessary.

Within an internal space of the endless intermediate belt 15, four primary transfer rollers 18 are disposed. Each primary transfer roller 18 opposes one of the photosensitive drums 7 via the lower portion (flat-plate portion) of the intermediate belt 15.

During image formation, the intermediate belt 15 circularly moves in a counterclockwise direction in FIG. 1. The toner image formed on the surface of each photosensitive drum 7 is sequentially transferred onto the intermediate belt 15 when the intermediate belt 15 is pinched between each pair of the photosensitive drum 7 and the primary transfer roller 18. In this way, a colored toner image is formed on the intermediate belt 15.

A secondary transfer roller 19 is disposed at a position opposing the roller 17 such that the intermediate belt 15 is interposed between the roller 17 and the secondary transfer roller 19. The secondary transfer roller 19 is in contact with the intermediate belt 15.

The sheet feed cassette 20 is disposed at a bottom end portion of the main casing 2. The sheet feed cassette 20 accommodates a stack of sheets therein. Each sheet accommodated in the sheet feed cassette 20 is conveyed toward a position between the intermediate belt 15 and the secondary transfer roller 19 by various rollers. As the sheet passes between the intermediate belt 15 and the secondary transfer roller 19, the colored toner image on the intermediate belt 15 is transferred onto the sheet.

The fixing device 21 is positioned above the roller 17 and the secondary transfer roller 19. The sheet on which the toner image has been transferred is then conveyed to the fixing device 21, whereby the toner image is thermally fixed on the sheet. The image-formed sheet is finally discharged onto a sheet discharge tray 22 that is formed on an upper surface of the main casing 2 by various rollers.

Above the main casing 2, a scanner 23 is provided. The scanner 23 scans data of documents placed thereon. The color printer 1 can reproduce the documents on the sheets based on the data scanned at the scanner 23 (a copy function). Further, the color printer 1 can also transmit the scanned data to a personal computer connected to the color printer 1 (a scanner function). Still further, the color printer 1 can transmit the scanned data to a facsimile device over public telephone lines (a facsimile function).

2. Detailed Construction of the Drawer Unit

Next, a detailed construction of the drawer unit 3 will be described with reference to FIGS. 1 through 11.

2-1. Drawer Frame

Figure 5:
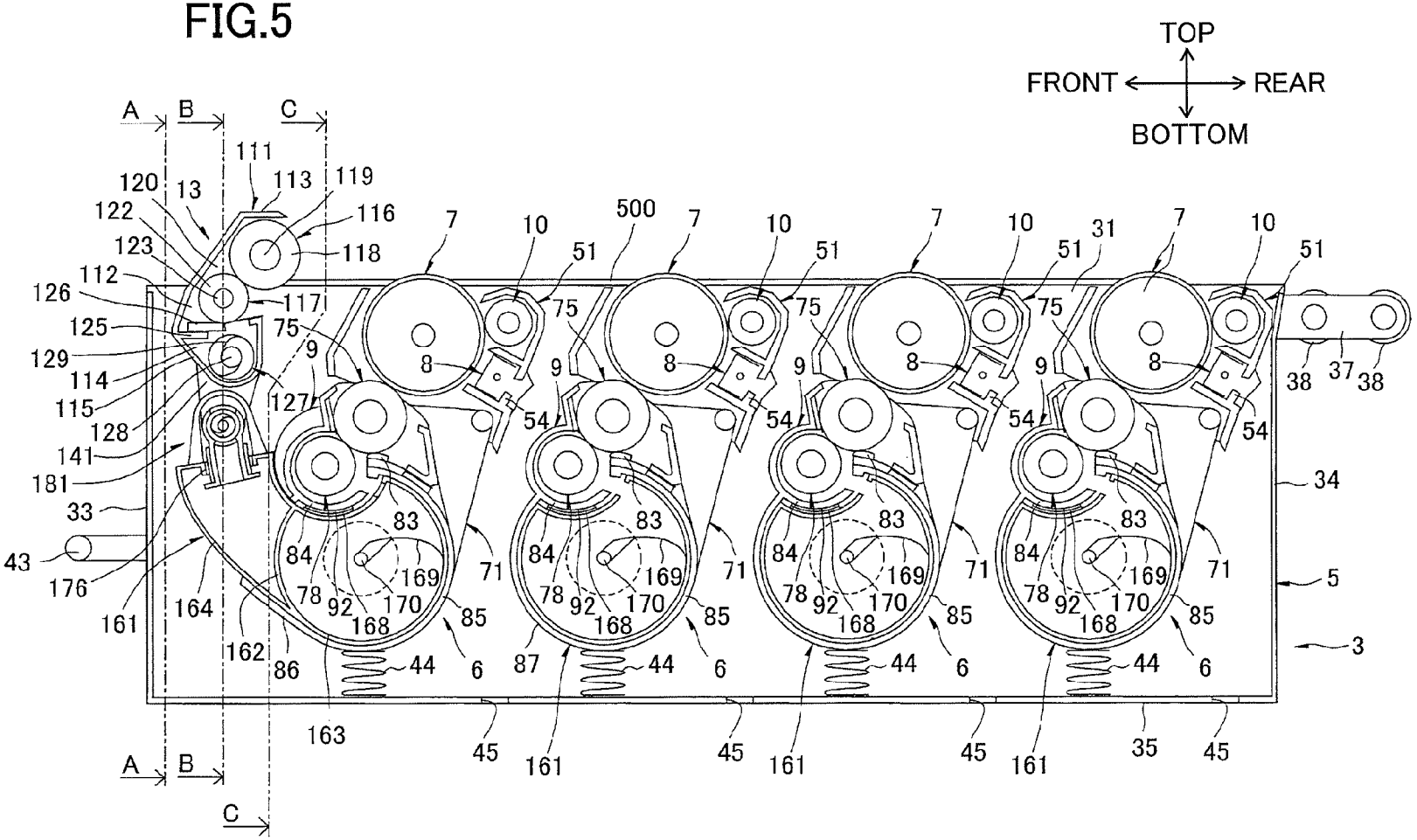
FIG. 5 is a vertical cross-sectional view of the drawer unit, the drawer unit including a drawer frame.

The drawer frame 5 of the drawer unit 3 has a substantially rectangular box shape whose top surface is open, as shown in FIG. 5. Specifically, the drawer frame 5 includes a left side wall 31, the right side wall 32, a front wall 33, a rear wall 34 and a bottom wall 35. The left side wall 31 and the right side wall 32 are disposed in opposition to each other in the left-to-right direction (see FIGS. 6 and 7). The front wall 33 spans between front end portions of the left side wall 31 and the right side wall 32, while the rear wall 34 spans between rear end portions of the left side wall 31 and the right side wall 32. The bottom wall 35 functions to close a space defined by the left side wall 31, the right side wall 32, the front wall 33 and the rear wall 34 from below. In other words, the drawer frame 5 has an aperture 500 defined by upper peripheral end portions of the left side wall 31, the right side wall 32, the front wall 33 and the rear wall 34.

Each of the right side wall 32 and the left side wall 31 has an outer surface on which a guide roller 36 is rotatably provided. Specifically, the guide roller 36 is disposed at a lower front end portion of each outer surface of the right side wall 32 and the left side wall 31, as shown in FIG. 4. Each guide roller 36 is rotatable about its axis extending in the left-to-right direction. Each guide roller 36 faces each other in the left-to-right direction.

Each of the right side wall 32 and the left side wall 31 is further provided with a roller supporting member 37. As shown in FIGS. 4 and 5, each roller supporting member 37 is disposed at an upper rear end portion of each of the right side wall 32 and the left side wall 31. The roller supporting member 37 has a plate-like shape extending toward the rear and having a certain thickness in the left-to-right direction. On an outer surface of each roller supporting member 37, two guide rollers 38 are provided such that the two guide rollers 38 are spaced away from each other in the front-to-rear direction. Each guide roller 38 is rotatable about its axis extending in the left-to-right direction.

The main casing 2 has a pair of side walls opposing each other in the left-to-right direction. As shown in FIG. 4, each side wall of the main casing 2 is formed with a front guide groove 39 and a rear guide groove 40. Each front guide groove 39 is adapted to receive each guide roller 36, and each rear guide groove 40 is adapted to receive the two guide rollers 38 provided on each roller supporting member 37.

The front guide grooves 39 opposing each other in the left-to-right direction define a distance therebetween identical to that defined between the guide rollers 36. Each front guide groove 39 has a rectangular cross-section and is depressed outward in the left-to-right direction. Each front guide groove 39 extends, from a front end portion of each side wall of the main casing 2, first rearward and then bends diagonally upward and rearward. At the bent corner of each front guide groove 39, a pressing member 41 is disposed for pressing (biasing) the guide roller 36 upward. The pressing member 41 may be a leaf spring or a coil spring.

Each rear guide groove 40 is arranged upward of the corresponding guide groove 39 and spaced away therefrom. Each rear guide groove 40 also has a rectangular cross-section and is depressed outward in the left-to-right direction. The rear guide groove 40 extends in the front-to-rear direction and has a length substantially identical to that of the drawer unit 3 (the drawer frame 5) in the front-to-rear direction.

Each rear guide groove 40 has a rear end portion whose width in the vertical direction is greater than a remaining portion of the rear guide groove 40. In other words, the rear end portion of each rear guide groove 40 has a top surface on which a step is formed, the step being vertically higher than the remaining portion of the rear guide groove 40. A pressing member 42 is disposed at the rear end portion of each rear guide groove 40 for pressing the corresponding guide rollers 38 upward. The pressing member 42 may be a leaf spring or a coil spring.

When the drawer unit 3 is in the accommodated position, each guide roller 36 is inserted into each front guide groove 39 and the pair of guide rollers 38 provided on each roller supporting member 37 is inserted into the corresponding rear guide groove 40. When the drawer unit 3 is in the pulled-out position, each guide roller 36 is disengaged from each front guide groove 39, but the pair of guide rollers 38 is inserted into the rear guide groove 40. While the drawer unit 3 is being moved between the accommodated position and the pulled-out position, the guide rollers 38 move, while rotating, within and along the corresponding rear guide groove 40. The guide roller 36 moves along the front guide groove 39 while the drawer unit 3 is moved around and at the accommodated position.

While the drawer unit 3 is being moved to the accommodated position from the vicinity of the accommodated position, the guide roller 36 and the pair of guide rollers 38 are respectively applied with pressing forces from the pressing members 41 and 42. Due to the pressing forces, the guide roller 36 and the pair of guide rollers 38 are being moved rearward and upward respectively within the front guide groove 39 and the rear guide groove 40 to enable the drawer unit 3 is lifted upward while being moved rearward. As a result, when the drawer unit 3 is in the accommodated position, each photosensitive drum 7 is in contact with the lower portion of the intermediate belt 15, as shown in FIGS. 1 and 2.

On the other hand, when the drawer unit 3 is slightly moved frontward from the accommodated position, the guide roller 36 and the pair of guide rollers 38 rotate and move frontward and downward, thereby moving the drawer unit 3 frontward and downward. As a result, each photosensitive drum 7 is separated from the intermediate belt 15. This construction can prevent the photosensitive drums 7 from being slid with the intermediate belt 15 while the drawer unit 3 is being moved.

On the front wall 33, a grip 43 is provided for enabling the user to hold the same while the drawer unit 3 is being moved.

Figure 6:
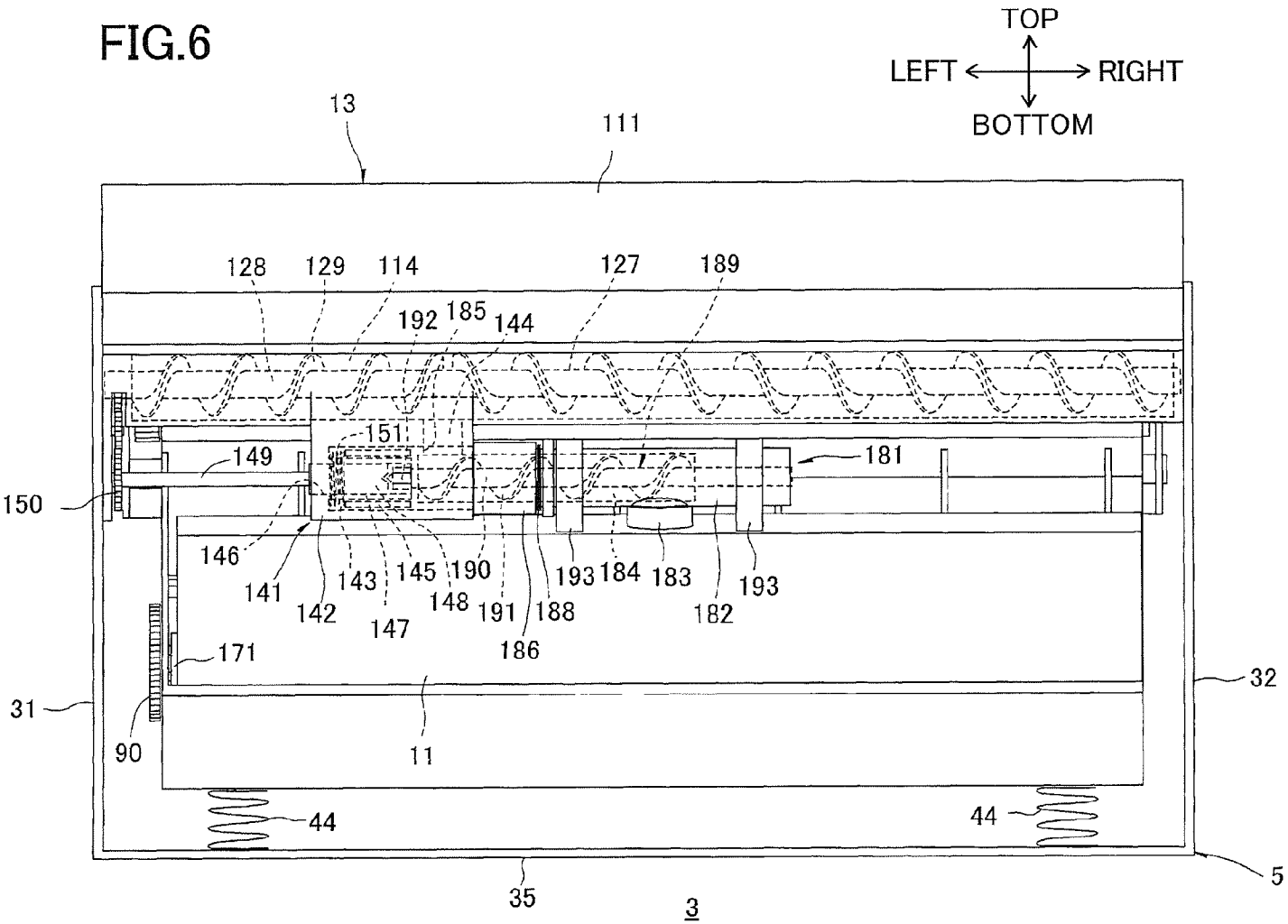
FIG. 6 is a cross-sectional view of the drawer unit taken along a line A-A of FIG. 5.
Figure 7:
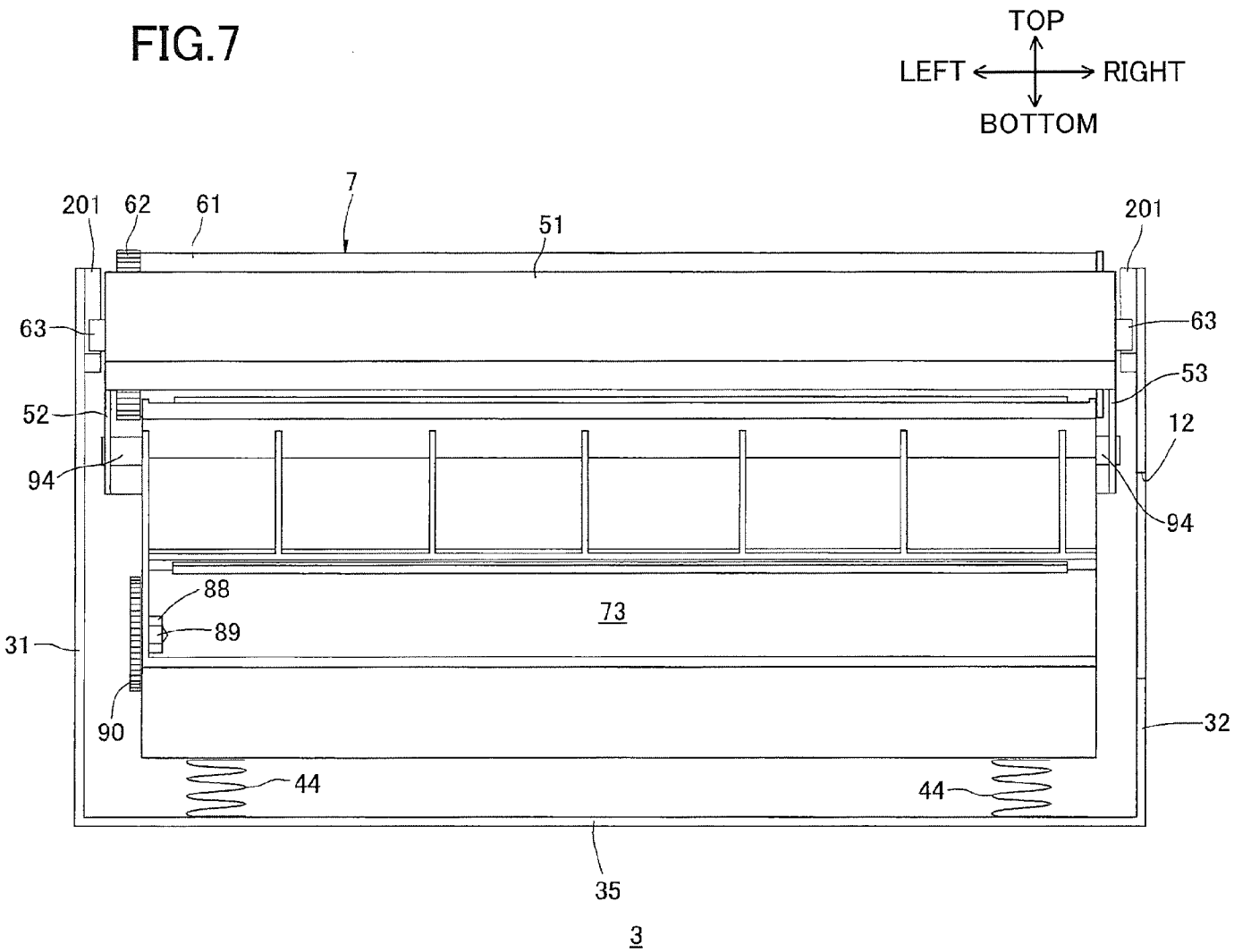
FIG. 7 is a cross-sectional view of the drawer unit taken along a line C-C of FIG. 5, wherein the toner cartridge for black is detached from the drawer frame.

As shown in FIGS. 5, 6 and 7, for each process unit 6, a pair of biasing members 44 is provided on the bottom wall 35 such that each biasing member 44 is separated from the other biasing member 44 in the left-to-right direction. In other words, four pairs of biasing members 44 are disposed on the bottom wall 35. Each pair of biasing members 44 biases the corresponding process unit 6 upward when the process unit 6 is mounted. On the bottom wall 35, four beam penetrating holes 45 are formed so that laser beams emitted from the exposing device 14 can pass through the beam penetrating holes 45, as shown in FIGS. 1, 2 and 5.

2-2. Process Unit

As described earlier, each process unit 6 includes the photosensitive drum 7, the charger 8, the developing device 9 and the drum cleaner 10.

2-2-1. Unit Frame

Figure 8:
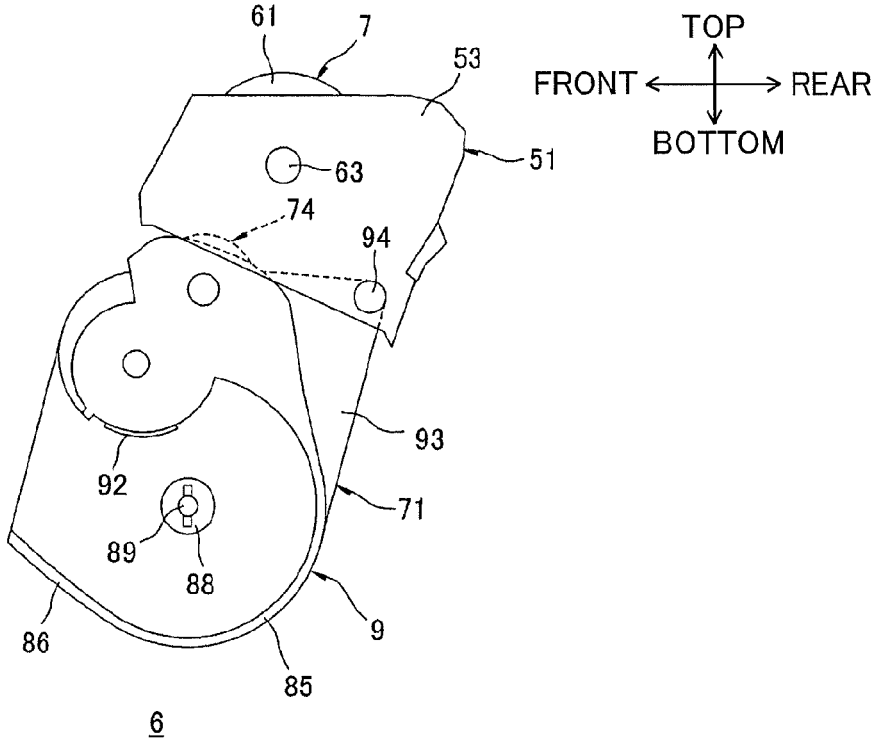
FIG. 8 is a right side view of the process unit, the process unit including a developing-device shutter.
Figure 9:
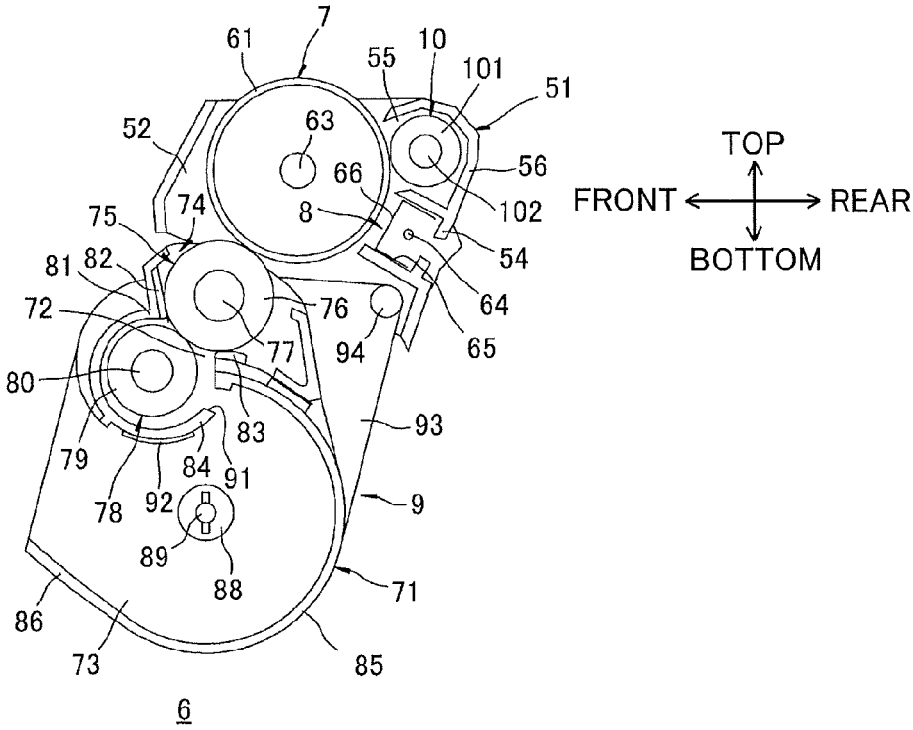
FIG. 9 is a cross-sectional view of the process unit, wherein the developing-device shutter is opened.
Figure 10:
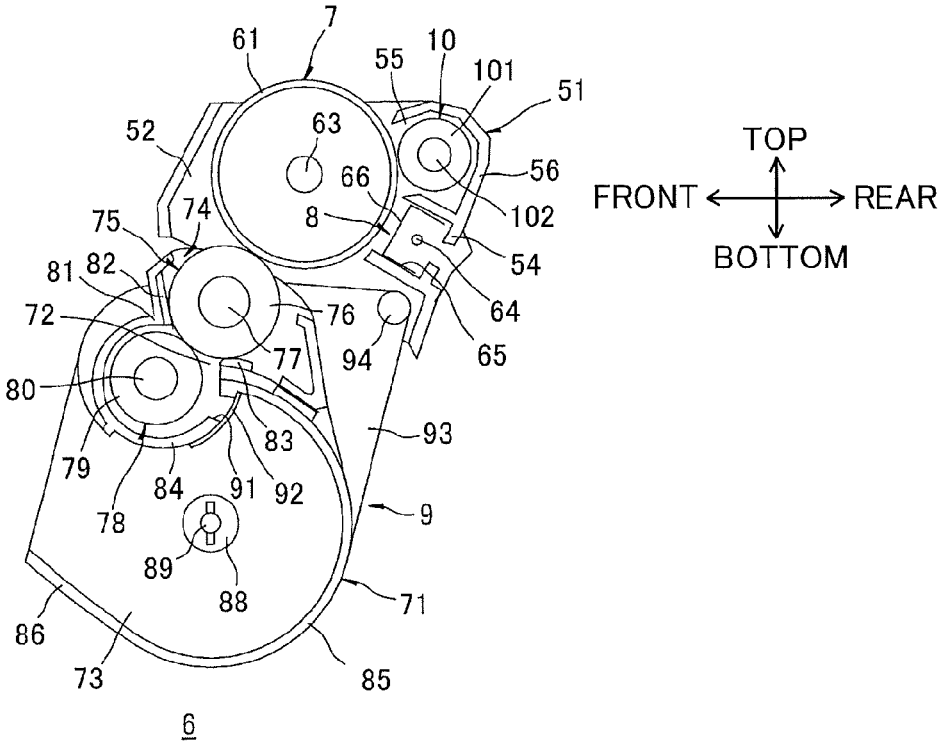
FIG. 10 is a cross-sectional view of the process unit, wherein the developing-device shutter is closed.

Each process unit 6 includes a unit frame 51, as shown in FIGS. 8, 9 and 10. The unit frame 51 includes a left side wall 52 (see FIGS. 9 and 10) and a right side wall 53 (see FIG. 8) facing each other in the left-to-right direction. Further, as show in FIGS. 9 and 10, the unit frame 51 includes a charger retaining portion 54 for holding the charger 8 and a cleaner wall portion 56 defining a cleaner accommodating space 55 for accommodating the drum cleaner 10 therein.

2-2-2. Photosensitive Drum

Each photosensitive drum 7 includes a cylindrical-shaped drum main body 61 and a drum shaft 63, shown in FIGS. 7 through 9. The drum main body 61 has a left end portion on which a drum gear 62 is provided such that the drum gear 62 does not rotate relative to the drum main body 61. A driving force from a motor (not shown) is inputted to the drum gear 62.

The drum shaft 63 is coaxially provided with the drum main body 61 and extends in the left-to-right direction. The drum main body 61 is rotatable relative to the drum shaft 63. The drum shaft 63 penetrates the left side wall 52 and the right side wall 53 of the unit frame 51 such that a left end portion and a right end portion of the drum shaft 63 protrude respectively outward from the left side wall 52 and the right side wall 53, as shown in FIG. 7. The drum shaft 63 is fixed to the left side wall 52 and the right side wall 53 so as not to rotate relative to the left side wall 52 and the right side wall 53.

Alternatively, the drum shaft 63 may be rotatably supported to the left side wall 52 and the right side wall 53, and the drum main body 61 may be supported to the drum shaft 63 so as not to rotate relative to the same.

2-2-3. Charger

The charger 8 is held to the charger retaining portion 54 of the unit frame 51. As shown in FIGS. 9 and 10, the charger retaining portion 54 is arranged diagonally downward and rearward of the photosensitive drum 7. The charger retaining portion 54 has a substantially angular C-shape in cross-section whose opening is oriented toward the photosensitive drum 7. The charger 8 includes a discharge wire 64 and a shield case 65. The discharge wire 64 and the shield case 65 extend in the left-to-right direction. The shield case 65 has a substantially angular C-shape in cross-section such that the discharge wire 64 is positioned within and along the shield case 65 with a prescribed distance kept therefrom. The shield case 65 is disposed to cover the opening of the charger retaining portion 54. The shield case 65 has a surface 66 opposing the photosensitive drum 7, the surface 66 functioning as a grid electrode 66 for controlling an amount of charges that falling onto the surface of the photosensitive drum 7. When a high voltage is applied to the discharge wire 64, a corona discharge is generated at the discharge wire 64 such that a surface of the photosensitive drum 7 is charged.

2-2-4. Developing Device

As shown in FIGS. 8 through 10, the developing device 9 includes a developing device casing 71 in which a developing chamber 72 and a cartridge mounting space 73 are formed.

The developing chamber 72 is formed at an upper portion of the developing device casing 71. The developing device casing 71 has a portion opposing the photosensitive drum 7, the portion being formed with an elongated opening 74 extending in the left-to-right direction. The developing chamber 72 is in communication with outside via the opening 74.

A developing roller 75 is rotatably provided at an upper portion of the developing chamber 72. The developing roller 75 includes a developing roller main body 76 and a developing roller shaft 77 extending in the left-to-right direction. The developing roller main body 76 has a cylindrical shape extending in the left-to-right direction and is provided around the developing roller shaft 77. The developing roller main body 76 and the developing roller shaft 77 are thus coaxially provided.

The developing roller shaft 77 has left and right end portions each penetrating through the developing device casing 71 and rotatably supported to the same. The developing roller 75 is thus rotatably supported to the developing device casing 71. A portion of the developing roller 75 is exposed from the developing device casing 71 through the opening 74.

A supply roller 78 is disposed diagonally downward and frontward of the developing roller 75 and in contact with the same. The supply roller 78 includes a cylindrical-shaped supply roller main body 79 and a supply roller shaft 80 extending in the left-to-right direction. The supply roller shaft 80 is coaxially provided on the supply roller main body 79. The supply roller shaft 80 has left and right end portions each penetrating through the developing device casing 71 and rotatable supported to the same so that the supply roller 78 can rotate relative to the developing device casing 71.

The developing device casing 71 is formed with a portion 81 protruding toward a position between the developing roller 75 and the supply roller 78. This portion 81 has a substantially V-shaped cross-section, as shown in FIGS. 9 and 10. A sealing member 82 is attached to the portion 81 to close a space formed between the portion 81 and the developing roller main body 76.

On an opposite side of the developing roller 75 from the sealing member 82, a thickness regulating blade 83 is provided to close a space formed between the developing roller 75 and the developing device casing 71. The thickness regulating blade 83 is formed of an insulating rubber, and extends in the left-to-right direction to span an entire length of the developing roller main body 76 in the left-to-right direction. The thickness regulating blade 83 is elastically in contact with the developing roller main body 76 from below.

Although not shown, other sealing members are provided for closing spaces formed between each widthwise end portion (left and right end portions) of the developing roller main body 76 and the developing device casing 71.

In this way, spaces between the developing roller main body 76 and the developing device casing 71 are closed by the sealing member 82, the thickness regulating blade 83 and the not-shown sealing members. The toner within the developing chamber 72 is thus prevented from leaking from anywhere between the developing roller main body 76 and the developing device casing 71.

The cartridge mounting space 73 is formed below the developing chamber 72. The developing device casing 71 further includes a partitioning wall 84 and an outer wall 85 defining the cartridge mounting space 73.

The partitioning wall 84 partitions the developing chamber 72 and the cartridge mounting space 73. The partitioning wall 84 is formed in a substantially semi-circular shape whose convex side faces the cartridge mounting space 73. In other words, the partitioning wall 84 is curved in an arcuate shape so as to be convex downward.

The outer wall 85 has an upper end portion connected to a rear end portion of the partitioning wall 84. The outer wall 85 has a substantially semi-circular shape whose curvature is greater than that of the partitioning wall 84. The outer wall 85 is curved in an arcuate shape so as to be convex rearward and downward.

The developing device 9 for black has a structure identical to those for yellow, cyan and magenta except the shape of the cartridge mounting space 73.

More specifically, as shown in FIGS. 9 and 10, in case of the developing device 9 for black, the developing device casing 71 is further formed with a flat plate portion 86 for defining the cartridge mounting space 73 together with the partitioning wall 84 and the outer wall 85. The flat plate portion 86 is connected to a lower end portion of the outer wall 85 and extends diagonally upward and frontward. In other words, the cartridge mounting space 73 is open frontward between the partitioning wall 84 and the flat plate portion 86. The cartridge mounting space 73 is further open rightward (toward the near side in FIGS. 9 and 10).

For the developing devices 9 for yellow, cyan and magenta, each developing device casing 71 is further formed with an arcuate portion 87 which is convex frontward and connected to the lower end portion of the outer wall 85, as shown in FIG. 5. The arcuate portion 87 has an upper end portion connected to the partitioning wall 84. That is, the cartridge mounting space 73 is defined by the partitioning wall 84, the outer wall 85 and the arcuate portion 87. The cartridge mounting space 73 is open only rightward.

As shown in FIGS. 7 and 8, the developing device casing 71 further includes a left end wall (shown without a reference numeral) that defines a left end of the cartridge mounting space 73. A developing-device coupling 88 is disposed at a substantially center of the left end wall. The developing-device coupling 88 includes a rotational shaft 89 extending in the left-to-right direction so that the developing-device coupling 88 can rotate relative to the left end wall about the rotational shaft 89. The rotational shaft 89 has a left end portion protruding from the left end wall of the developing device casing 71. A developing gear 90 is mounted on the left end portion of the rotational shaft 89 so that a driving force from a motor (not shown) can be inputted to the developing-device coupling 88 via the developing gear 90.

The partitioning wall 84 has an upper portion on which a communication port 91 is formed for achieving fluid communication between the developing chamber 72 and the cartridge mounting space 73. The communication port 91 has a rectangular shape elongated in the left-to-right direction, for example.

A developing-device shutter 92 is movably provided on the partitioning wall 84 on a side facing the cartridge mounting space 73. The developing-device shutter 92 is a thin plate-like member having an arcuate shape protruding toward the cartridge mounting space 73 in conformance with an outer profile of the partitioning wall 84. The developing-device shutter 92 functions to open and close the communication port 91.

The developing device casing 71 has left and right end portions from each of which a connecting section 93 protrudes diagonally upward and rearward. Each connecting section 93 has a substantially triangular shape in a side view. As shown in FIG. 8, each connecting section 93 has an upper end portion disposed inward of the either one of the left side wall 52 and the right side wall 53 in the left-to-right direction. Further, each connecting section 93 has an upper-rear end portion on which a pivot shaft 94 protruding outward in the left-to-right direction is formed. Each pivot shaft 94 penetrates through and is rotatably supported to the left side wall 52 or the right side wall 53 such that the developing device 9 is pivotally movable about the pivot shaft 94 relative to the unit frame 51 supporting the photosensitive drum 7 by a developing device moving mechanism. More specifically, the developing device 9 is pivotally movable about the pivot shaft 94 between a neighboring position where the developing roller 75 (the developing roller main body 76) is positioned close to the photosensitive drum 7 (shown in FIG. 1) and a separated position where the developing roller 75 (the developing roller main body 76) is separated from the photosensitive drum 7 (shown in FIG. 2).

It should be noted that, in the color printer 1 of this embodiment, the developing roller 75 is in contact with the photosensitive drum 7 when the developing device 9 is in the neighboring position, as shown in FIG. 1. However, in the neighboring position, the developing roller 75 may not necessarily be in contact with the photosensitive drum 7, but may be slightly spaced away from the photosensitive drum 7 by such a distance that toner on the developing roller 75 can be supplied to the photosensitive drum 7.

2-2-5. Drum Cleaner

The drum cleaner 10 is disposed within the cleaner accommodating space 55 defined by the cleaner wall portion 56, as shown in FIGS. 9 and 10. The drum cleaner 10 includes a cylindrical-shaped cleaning roller main body 101 and a cleaning roller shaft 102 both extending in the left-to-right direction. The cleaning roller shaft 102 protrudes outward from both widthwise end portions of the cleaning roller main body 101 in the left-to-right direction and is rotatably supported to the left side wall 52 and the right side wall 53 of the unit frame 51. The cleaning roller main body 101 is in contact with the photosensitive drum 7.

3. Belt Cleaner 13

As shown in FIG. 5, the belt cleaner 13 is disposed at an upper-front end portion of the drawer frame 5. The belt cleaner 13 includes a cleaner casing 111 configured of an accommodation chamber wall section 113 and a conveying chamber wall section 115. The accommodation chamber wall section 113 defines a roller accommodation chamber 112, while the conveying chamber wall section 115 defines a waste toner conveying chamber 114.

The accommodation chamber wall section 113 extends diagonally upward and rearward from a position below the aperture 500 (upper peripheral end of the drawer frame 5), and then bends rearward at a position above the aperture 500. The roller accommodation chamber 112 is therefore open rearward.

Within the roller accommodation chamber 112, a primary belt cleaning roller 116 and a secondary belt cleaning roller 117 are disposed.

The primary belt cleaning roller 116 includes a cylindrical-shaped roller main body 118 and a roller shaft 119 both extending in the left-to-right direction. The roller shaft 119 coaxially penetrates through the roller main body 118. As shown in FIG. 1, the roller main body 118 spans an entire length of the intermediate belt 15 in the left-to-right direction such that the intermediate belt 15 is nipped between the roller main body 118 and the roller 16, when the drawer unit 3 is in the accommodated position. The roller shaft 119 is rotatably supported to the cleaner casing 111.

Figure 11:
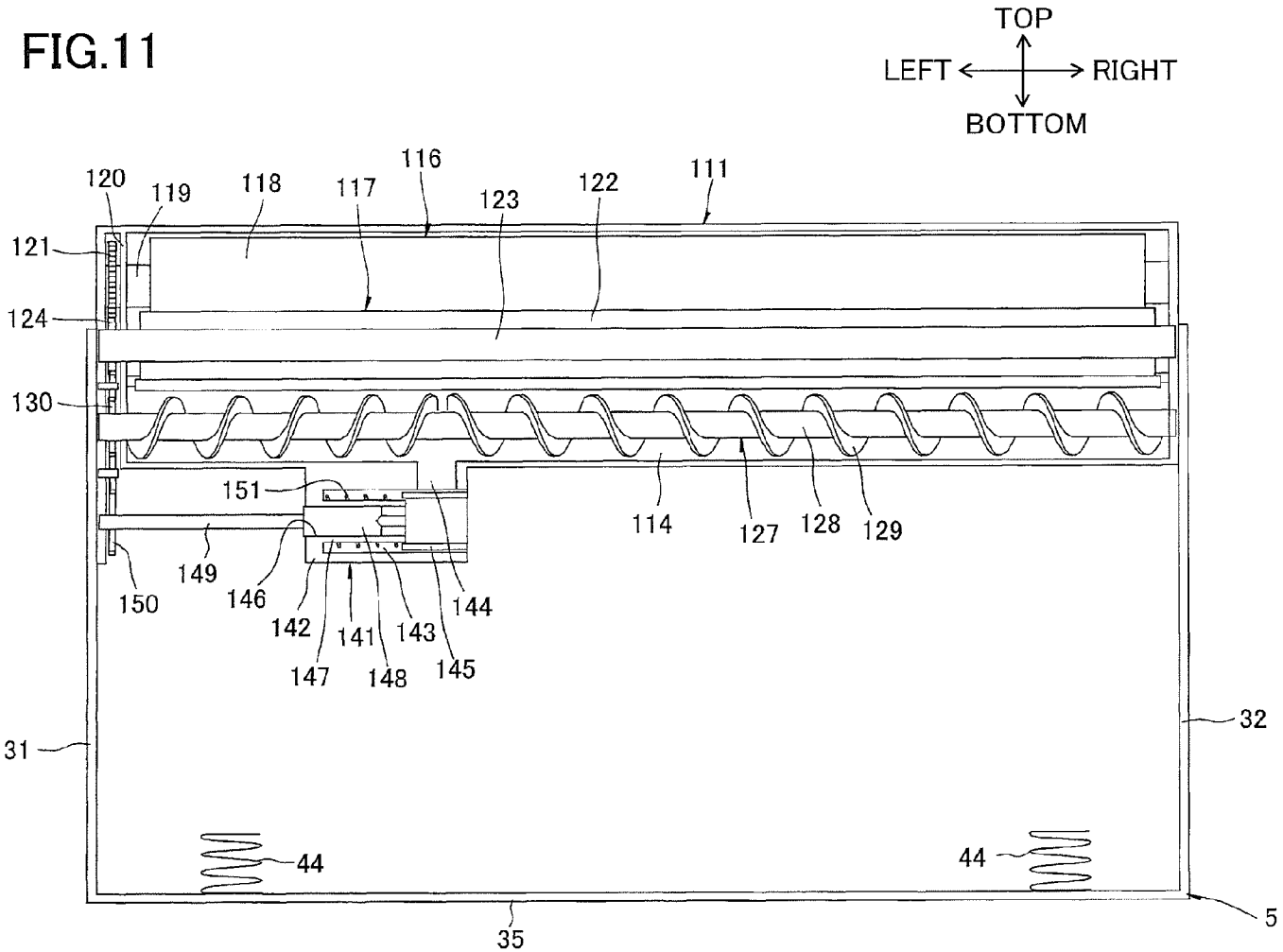
FIG. 11 is a cross-sectional view of the drawer unit taken along a line B-B of FIG. 5, wherein the process unit for black is detached from the drawer frame.

As shown in FIG. 11, the cleaner casing 111 further includes a left side plate 120. The roller shaft 119 has a left end portion that penetrates the left side plate 120 of the cleaner casing 111. A gear 121 is attached to the left end portion of the roller shaft 119 at a position leftward of the left side plate 120. A driving force from a motor (not shown) is inputted to the roller shaft 119 via the gear 121.

The secondary belt cleaning roller 117 includes a cylindrical-shaped roller main body 122 and a roller shaft 123 both extending in the left-to-right direction. The roller shaft 123 coaxially penetrates through the roller main body 122. The secondary belt cleaning roller 117 is disposed diagonally downward and frontward of the primary belt cleaning roller 116 such that the roller main body 122 is in contact with an entire length of the roller main body 118 in the left-to-right direction. The roller shaft 123 is rotatably supported to the cleaner casing 111.

As shown in FIG. 11, the roller shaft 123 has a left end portion that penetrates though the left side plate 120 of the cleaner casing 111 and a gear 124 is provided on the left end portion of the roller shaft 123 at a position leftward of the left side plate 120. A driving force from a motor (not shown) is inputted to the roller shaft 123 via the gear 124.

The conveying chamber wall section 115 has a substantially U-shaped cross-section which is open upward, as shown in FIG. 5. The conveying chamber wall section 115 has an upper-front end portion that is connected to a lower end portion of the accommodation chamber wall section 113. The cleaner casing 111 further includes a scraper retaining wall section 125 extending rearward from the position where the conveying chamber wall section 115 and the accommodation chamber wall section 113 are connected. A gap is formed between a rear end portion of the scraper retaining wall section 125 and an upper-rear end portion of the conveying chamber wall section 115. In other words, the waste toner conveying chamber 114 is open upward through the gap.

A scraper 126 is disposed on an upper surface of the rear end portion of the scraper retaining wall section 125. The scraper 126 has a plate-like shape, and extends in the left-to-right direction and in the front-to-rear direction. The scraper 126 has a rear end portion that is in contact with the roller main body 122 of the secondary belt cleaning roller 117 from a position frontward and downward of the secondary belt cleaning roller 117.

Within the waste toner conveying chamber 114, an auger 127 is disposed, as shown in FIGS. 5, 6 and 11. The auger 127 includes an auger shaft 128 extending in the left-to-right direction and an auger screw 129 provided on and along the auger shaft 128 in a spiral manner. The auger shaft 128 is rotatably supported to the cleaner casing 111. The auger shaft 128 has a left end portion that penetrates through the left side plate 120 of the cleaner casing 111. A gear 130 is attached to the left end portion of the auger shaft 128 at a position leftward of the left side plate 120. A driving force from a motor (not shown) is inputted to the gear 130 to rotate the auger 127.

As shown in FIG. 11, the auger screw 129 is provided on and along the auger shaft 128 in such a manner that the auger screw 129 has a first spiral portion provided on a leftward portion of the auger shaft 128 (about one-third of the entire length of the auger shaft 128 from its left end portion), and a second spiral portion provided on a remaining rightward portion of the auger shaft 128 (about two-thirds of the entire length of the auger shaft 128 from its right end portion). A helical direction of the first spiral portion is opposite to that of the second spiral portion.

2-4. Joint Conveying Unit

As shown in FIGS. 5, 6 and 11, a joint conveying unit 141 is disposed below the belt cleaner 13.

The joint conveying unit 141 includes a conveying chamber outer wall 142 that is integrally formed with the cleaner casing 111 of the belt cleaner 13. As shown in FIG. 11, the conveying chamber outer wall 142 protrudes downward from a lower end portion of the cleaner casing 111 at a position leftward of a center of the cleaner casing 111 in the left-to-right direction. The joint conveying unit 141 has a substantially rectangular shape in a front view.

Within the conveying chamber outer wall 142, a cylindrical-shaped waste toner conveying chamber 143 is formed as an example of a cylindrical portion. The waste toner conveying chamber 143 is open rightward, but is closed at its left end by a left end wall of the conveying chamber outer wall 142.

On the conveying chamber outer wall 142, a communication chamber 144 is formed at such a position that the communication chamber 144 vertically opposes the position where the first spiral portion and the second spiral portion of the auger screw 129 meet. The communication chamber 144 connects the waste toner conveying chamber 114 of the belt cleaner 13 and the waste toner conveying chamber 143 of the joint conveying unit 141 so as to allow fluid communication therebetween. The communication chamber 144 is an example of an opening.

Within the waste toner conveying chamber 143, a cylindrical-shaped communication chamber shutter 145 is accommodated. The communication chamber shutter 145 has an outer diameter substantially identical to an inner diameter of the waste toner conveying chamber 143. The communication chamber shutter 145 is movable between a communication position (leftmost position within the waste toner conveying chamber 143) where the waste toner conveying chamber 143 and the communication chamber 144 are in communication with each other and a shut-down position (rightmost position within the waste toner conveying chamber 143) where the waste toner conveying chamber 143 is prevented from communicating with the communication chamber 144.

On the left end wall of the conveying chamber outer wall 142, a circular-shaped through-hole 146 is formed. The through-hole 146 is coaxially positioned relative to the waste toner conveying chamber 143. A cylindrical-shaped coupling accommodation wall 147 is formed on a peripheral end of the through-hole 146. The coupling accommodation wall 147 is integrally formed with the conveying chamber outer wall 142 and protrudes toward the waste toner conveying chamber 143 from the peripheral end of the through-hole 146.

Within a space surrounded by the coupling accommodation wall 147, a cleaner coupling 148 is accommodated. The cleaner coupling 148 includes a rotational shaft 149 extending in the left-to-right direction so that the cleaner coupling 148 can rotate about the rotational shaft 149. The rotational shaft 149 extends leftward of the conveying chamber outer wall 142 and has a left end portion to which a gear 150 is attached for receiving a driving force from a motor (not shown).

A coil spring 151 is disposed so as to surround an outer circumferential surface of the coupling accommodation wall 147. The coil spring 151 has a left end portion fixed to the left end wall of the conveying chamber outer wall 142, and a right end portion fixed to the communication chamber shutter 145. Due to a biasing force of the coil spring 151, the communication chamber shutter 145 is constantly biased rightward to be at the shut-down position.

3. Detailed Construction of the Toner Cartridge 3-1. Toner Cartridge for Black

The toner cartridge 11 for black (hereinafter, to be referred to as a toner cartridge 11K) has a shape different from those of the toner cartridges for yellow, cyan and magenta, as shown in FIG. 4. The toner cartridge 11K has a size greater than those of other toner cartridges 11 for yellow, cyan and magenta. Hereinafter, a detailed construction of the toner cartridge 11K will be described with reference to FIGS. 12 through 18.

Figure 14:
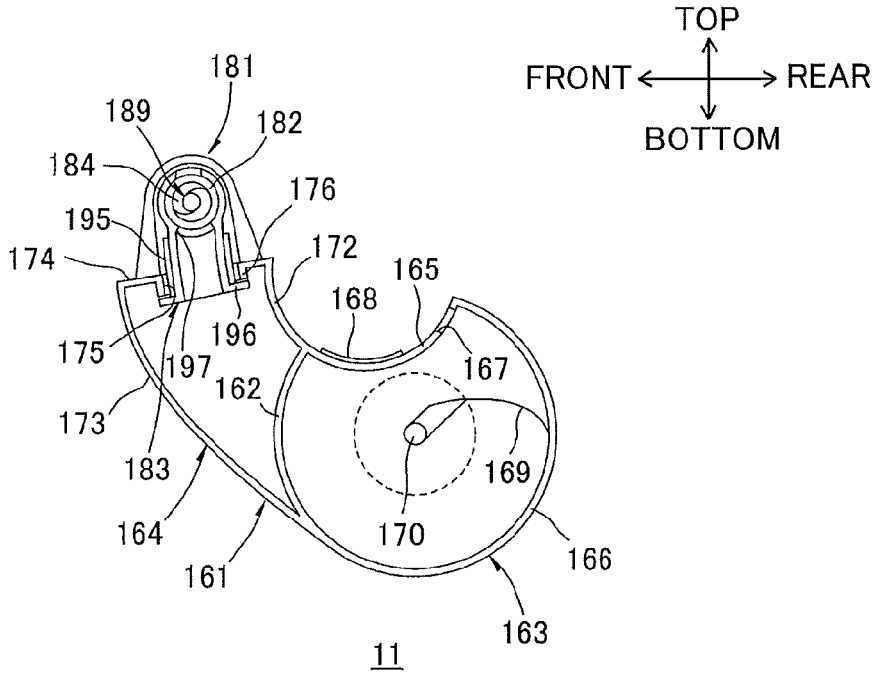
FIG. 14 is a cross-sectional view of the toner cartridge for black, wherein its cartridge shutter is opened.
Figure 15:
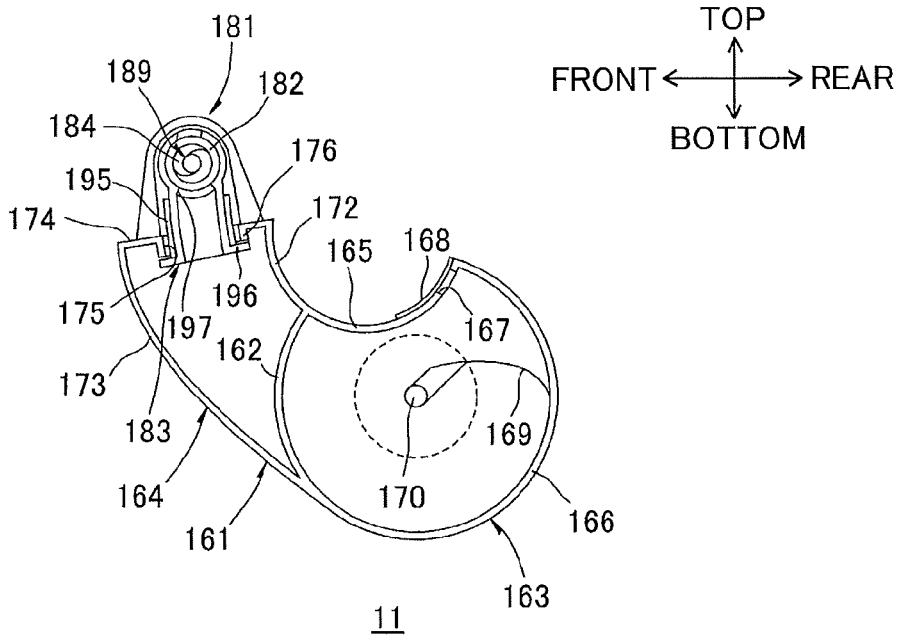
FIG. 15 is a cross-sectional view of the toner cartridge for black, wherein the cartridge shutter is closed.

The toner cartridge 11K includes a casing 161. Within the casing 161, a partitioning wall 162 is provided, as shown in FIGS. 14 and 15. The partitioning wall 162 partitions an internal space defined by the casing 161 into two spaces: a frontward space functioning as a waste toner accommodation portion 164 and a rearward space functioning as a toner accommodation portion 163.

The toner accommodation portion 163 stores therein toner to be supplied to the developing device 9. The waste toner accommodation portion 164 accommodates waste toner collected from the intermediate belt 15 and the photosensitive drums 7. In other words, the casing 161 integrally includes the toner accommodation portion 163 and the waste toner accommodation portion 164.

The toner accommodation portion 163 has such a cross-sectional shape that an upper portion of a circle is recessed toward a center of the circle in an arcuate manner. More specifically, as shown in FIGS. 14 and 15, the toner accommodation portion 163 is defined by a first arcuate portion 165, a second arcuate portion 166 and the partitioning wall 162. In a side view, the partitioning wall 162 is formed in an arcuate shape that is convex frontward and extends in the vertical direction. The first arcuate portion 165 has an arcuate shape in a side view. The first arcuate portion 165 has a front end portion connected to an upper end portion of the partitioning wall 162, and extends rearward therefrom while forming an arc that is convex downward. The first arcuate portion 165 has a curvature generally identical to that of the partitioning wall 84 of the developing device casing 71. The second arcuate portion 166 connects a bottom end portion of the partitioning wall 162 and a rear end portion of the first arcuate portion 165. The second arcuate portion 166 has a substantially semi-circular shape in a side view, being convex downward and rearward. The second arcuate portion 166 has a curvature generally identical to that of the outer wall 85 of the developing device casing 71.

The first arcuate portion 165 has a rear end portion on which a toner discharging outlet 167 is formed. The toner discharging outlet 167 has a shape and a size substantially identical to those of the communication port 91 formed on the partitioning wall 84 of the developing device casing 71 (see FIGS. 9 and 10). When the toner cartridge 11K is mounted on the cartridge mounting space 73 of the developing device 9 for black, the toner discharging outlet 167 is in confrontation with the communication port 91 at a position diagonally downward and rearward of the communication port 91.

On a top surface of the first arcuate portion 165, a cartridge shutter 168 is movably provided for opening and closing the toner discharging outlet 167. The cartridge shutter 168 is a thin plate-like member having an arcuate-shaped side view. The cartridge shutter 168 is convex downward in conformance with an outer profile of the first arcuate portion 165. The cartridge shutter 168 has a shape and a size substantially identical to those of the developing-device shutter 92 of the developing device 9.

Figure 12:
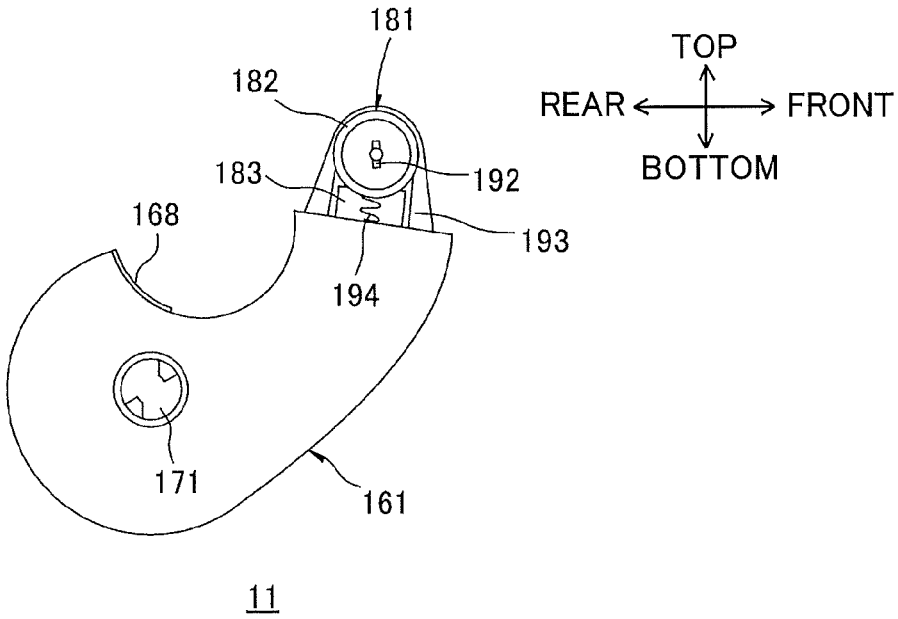
FIG. 12 is a left side view of the toner cartridge for black.
Figure 13:
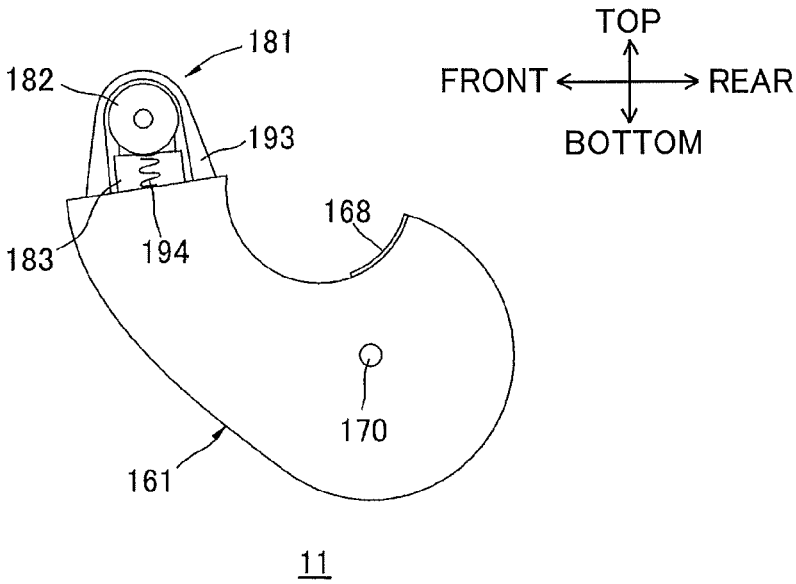
FIG. 13 is a right side view of the toner cartridge for black.

Within the toner accommodation portion 163, an agitator 169 is disposed. The agitator 169 is formed of a film and is fixed to an agitator shaft 170 extending in the left-to-right direction. The agitator shaft 170 is rotatably supported to the casing 161 (left and right side walls of the casing 161), as shown in FIGS. 12 and 13. The agitator shaft 170 has a left end portion that protrudes leftward from the left side wall of the casing 161 (outward of the toner accommodation portion 163). An agitator coupling 171 is attached to the left end portion of the agitator shaft 170, as shown in FIG. 12. The agitator coupling 171 is adapted to be coupled to the developing-device coupling 88 (see FIGS. 7 and 8) of the developing device 9.

The waste toner accommodation portion 164 is defined by an arcuate portion 172, a flat plate portion 173 and an upper plate portion 174.

The arcuate portion 172 has a substantially arcuate shape in a side view. The arcuate portion 172 has a bottom end portion connected to the upper end portion of the partitioning wall 162, and extends therefrom upward and frontward while curving frontward in a convex manner. The arcuate portion 172 has a curvature generally identical to that of the partitioning wall 84 of the developing device casing 71. The flat plate portion 173 extends diagonally upward and frontward from a bottom end portion of the partitioning wall 162. The upper plate portion 174 connects upper end portions of the arcuate portion 172 and the flat plate portion 173.

As shown in FIGS. 14 and 15, the upper plate portion 174 has a central portion in the left-to-right direction on which a circular through-hole 175 is formed. The circular through-hole 175 has a peripheral end portion from which a connecting portion 176 protrudes downward (toward the waste toner accommodation portion 164). The connecting portion 176 has a generally cylindrical shape but is very flat. More specifically, although not obvious from the drawings, the connecting portion 176 is formed such that the connecting portion 176 has a circular arc shape in vertical cross-portion, whose center is coincident with the axis of the pivot shaft 94. The connecting portion 176 is disposed at a center of the developing device 9 in the axial direction.

A cartridge-side conveying unit 181 is provided upward of the casing 161, as shown in FIGS. 12 to 18. The cartridge-side conveying unit 181 includes a cylindrical-shaped main body portion 182 and a connected portion 183. The main body portion 182 extends in the left-to-right direction and the connected portion 183 extends downward from the main body portion 182.

Figure 17:
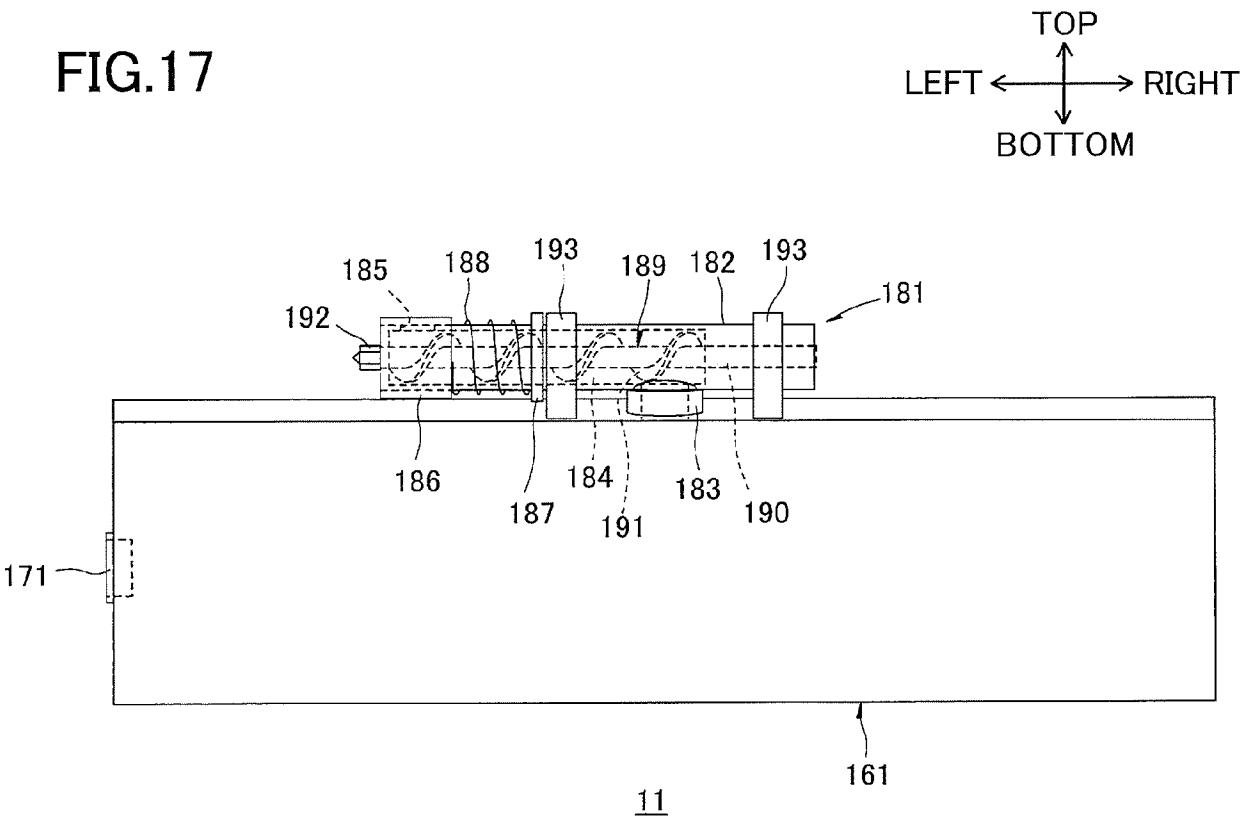
FIG. 17 is a front view of the toner cartridge for black, wherein internal components of the cartridge-side conveying section are shown in broken lines.

The main body portion 182 has an outer diameter substantially identical to the inner diameter of the waste toner conveying chamber 143 of the joint conveying unit 141 (see FIG. 11). Within the main body portion 182, a cylindrical-shaped waste toner conveying chamber 184 is formed, as shown in FIG. 17. The waste toner conveying chamber 184 has a left end defined by a left end wall of the main body portion 182 and extends rightward to a position rightward of a center of the cartridge-side conveying unit 181 in the left-to-right direction (to be referred to as a right end of the waste toner conveying chamber 184).

Figure 18:
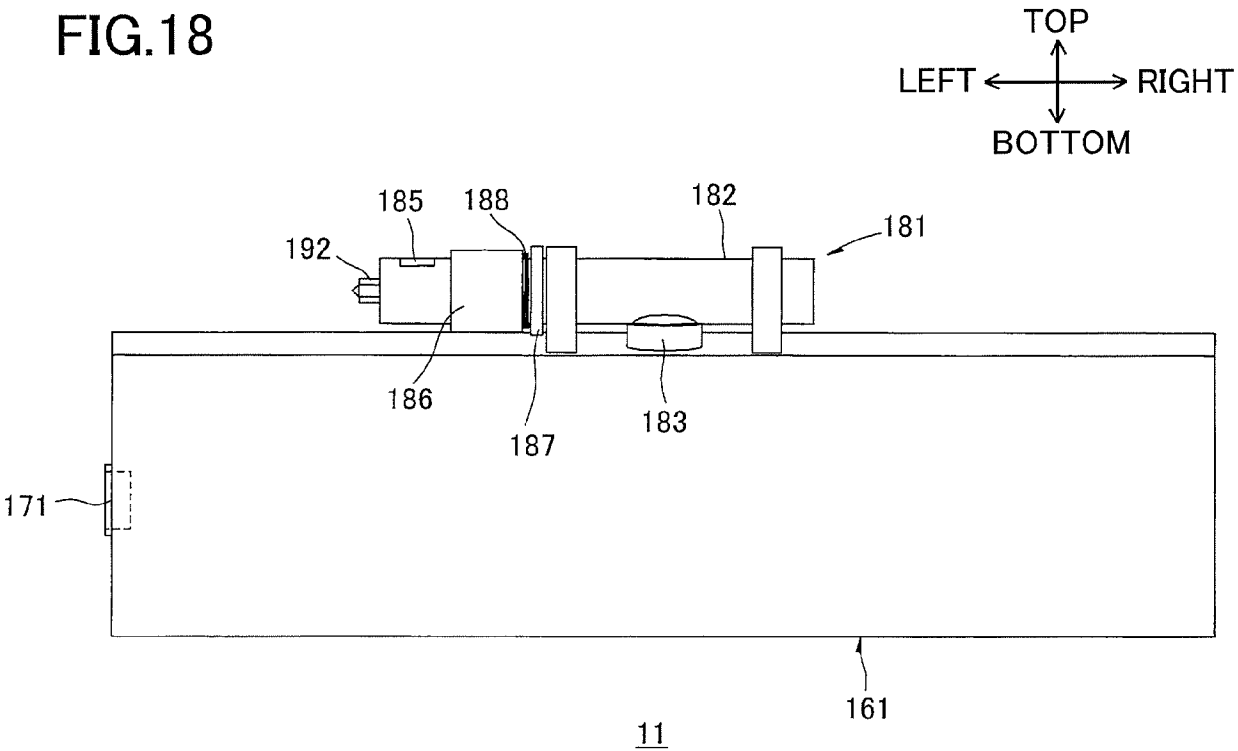
FIG. 18 is a front view of the toner cartridge for black, wherein the receiving port shutter of the cartridge-side conveying section is in an open position.

The main body portion 182 has a left end portion on which a waste toner receiving port 185 is formed, as shown in FIGS. 17 and 18. The waste toner receiving port 185 is open upward, and, has a shape and a size substantially identical to those of the communication chamber 144 of the joint conveying unit 141. When the toner cartridge 11K is mounted on the cartridge mounting space 73 of the developing device 9, the waste toner receiving port 185 confronts the communication chamber 144 from below.

A cylindrical-shaped receiving port shutter 186 is provided to surround an outer circumferential surface of the main body portion 182. The receiving port shutter 186 is movable in the left-to-right direction. The receiving port shutter 186 has an inner diameter generally identical to the outer diameter of the main body portion 182. A shutter stopper 187 is provided on the main body portion 182 at a position substantially center of the main body portion 182 in the left-to-right direction. The shutter stopper 187 has a flange-like shape protruding radially outward from the outer circumferential surface of the main body portion 182. The receiving port shutter 186 has a length in the left-to-right direction about a half of a length between a left end of the main body portion 182 and the shutter stopper 187. That is, the receiving port shutter 186 is movable in the left-to-right direction between the left end of the main body portion 182 and the shutter stopper 187. In other words, the receiving port shutter 186 is movable between an open position where the receiving port shutter 186 opens the waste toner receiving port 185 (FIG. 18) and a closing position where the receiving port shutter 186 closes the waste toner receiving port 185 (FIG. 16).

Between the receiving port shutter 186 and the shutter stopper 187, a coil spring 188 is provided to surround the outer circumferential surface of the main body portion 182. The coil spring 188 has a left end fixed to a right end portion of the receiving port shutter 186, and a right end fixed to the shutter stopper 187. Due to a biasing force of the coil spring 188, the receiving port shutter 186 is constantly biased leftward to be at the closing position.

Within the waste toner conveying chamber 184, an auger 189 is disposed, as shown in FIG. 17. The auger 189 includes an auger shaft 190 extending in the left-to-right direction and an auger screw 191 spirally provided on and along the auger shaft 190. The auger shaft 190 is rotatably supported to the main body portion 182. The auger shaft 190 has a left end portion protruding leftward from the main body portion 182. A cartridge coupling 192 is provided on the left end portion protruding from the main body portion 182. The cartridge coupling 192 is adapted to be coupled to the cleaner coupling 148 of the joint conveying unit 141 (see FIG. 11).

Figure 16:
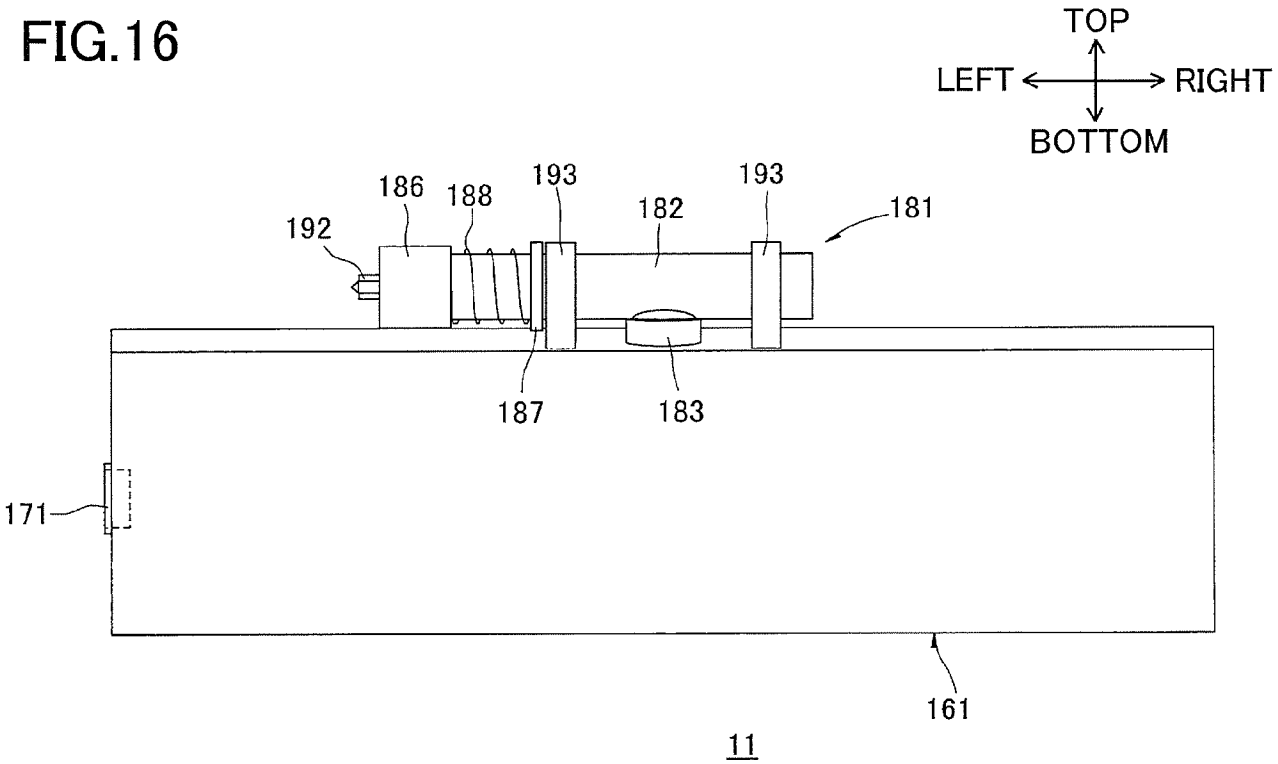
FIG. 16 is a front view of the toner cartridge for black, the toner cartridge for black having a cartridge-side conveying section including a receiving port shutter.

A pair of supporting portions 193 is provided on an upper end portion of the casing 161, as shown in FIGS. 16 and 18. The supporting portions 193 are spaced away from each other and positioned on a center portion of the upper end portion of the casing 161 in the left-to-right direction. Each supporting portion 193 has a substantially inverted U-shaped cross-section, as shown in FIGS. 12 to 15. That is, the supporting portion 193 protrudes upward from the upper end portion of the casing 161 and is open downward. A rightward portion of the main body portion 182 (a portion rightward of the shutter stopper 187) is inserted into and penetrates through an internal space formed by each supporting portion 193. As shown in FIGS. 12 and 13, a spring 194 is disposed within the internal space of each supporting portion 193 such that the spring 194 is interposed between the main body portion 182 and the casing 161. The spring 194 biases the main body portion 182 upward so as to urge the main body portion 182 away from the casing 161.

The connected portion 183 has a substantially cylindrical shape extending in the vertical direction, while curving such that the connected portion 183 is convex frontward. In other words, as shown in FIGS. 14 and 15, the connected portion 183 has a circular arc shape in vertical cross-section, whose center is coincident with the axis of the pivot shaft 94. The connected portion 183 has an outer diameter slightly smaller than an inner diameter of the connecting portion 176 formed on the casing 161, and is inserted into the connecting portion 176 such that the connecting portion 176 is movable relative to the connected portion 183. In other words, the connecting portion 176 (the waste toner accommodation portion 164) is movable relative to the auger 127, the joint conveying unit 141 and the cartridge-side conveying unit 181. The connected portion 183 has an outer circumferential surface to which a sealing member 195 is attached. In this way, the sealing member 195 functions to seal a space between the outer circumferential surface of the connected portion 183 and an inner circumferential surface of the connecting portion 176. The connected portion 183 has a bottom end portion on which a flange 196 is formed. The flange 196 protrudes radially outward from the bottom end portion of the connected portion 183.

The main body portion 182 has a portion enclosed by the connected portion 183 on which an inner communication port 197 is formed. The waste toner conveying chamber 184 of the main body portion 182 and an inner space of the connected portion 183 are in fluid communication with each other via the inner communication port 197.

3-2. Toner Cartridge for Yellow, Cyan and Magenta

The toner cartridges 11 for yellow, cyan and magenta have a structure identical to that of the toner cartridge 11K except that these toner cartridges 11 other than toner cartridge 11K are not provided with the waste toner accommodation portion 164 and the cartridge-side conveying unit 181.

4. Mounting and Detachment of the Process Unit

As shown in FIGS. 3 and 4, the process units 6 are mounted on and removed from the drawer frame 5 of the drawer unit 3 from above when the front cover 4 is opened and the drawer unit 3 is pulled out from the main casing 2 (in the pulled-out position).

Specifically, as shown in FIGS. 3 and 7, the left side wall 31 of the drawer frame 5 has an inner surface on which four guide grooves 201 are formed, each guide groove 201 being provided at a position corresponding to that of each the process unit 6. Likewise, the right side wall 32 of the drawer frame 5 has an inner surface on which four guide grooves 201 are formed each at a position corresponding to that of each process unit 6. In other words, each the guide groove 201 formed on the left side wall 31 is arranged in opposition to the corresponding one of the guide grooves 201 formed on the right side wall 32 in the left-to-right direction. Each guide groove 201 has a substantially U-shape in a side view, extending diagonally downward and frontward from the upper peripheral end portion of the left side wall 31 or the right side wall 32.

In order to mount the process unit 6, the user holds the process unit 6 and places the same above the drawer frame 5. As the user moves the process unit 6 downward, both widthwise ends of the drum shaft 63 of the photosensitive drum 7 are respectively inserted into the corresponding guide grooves 201 opposing each other in the left-to-right direction. As the drum shaft 63 is guided downward along the guide grooves 201, the process unit 6 is also moved downward along the guide grooves 201. When each widthwise end of the drum shaft 63 is in abutment with a bottom end of the corresponding guide groove 201, mounting of the process unit 6 into the drawer frame 5 is completed. At this time, each process unit 6 is biased upward due to the biasing forces applied from the pair of biasing members 44 provided therefor.

In order to remove the process unit 6 from the drawer frame 5, the user pulls the process unit 6 upward. As the drum shaft 63 moves upward along the guide grooves 201, the process unit 6 is also moved upward along the guide grooves 201. When the drum shaft 63 is released from the guide grooves 201, removal of the process unit 6 from the drawer frame 5 is completed.

5. Mounting and Detachment of the Toner Cartridge

For mounting the toner cartridge 11, as shown in FIG. 4, the front cover 4 is opened and the drawer unit 3 is pulled out from the main casing 2. When the drawer unit 3 is in the pulled-out position, each toner cartridge 11 is inserted into the drawer frame 5 through each cartridge replacement hole 12 formed on the right side wall 32 of the drawer frame 5. When the process unit 6 has been mounted in the drawer frame 5, the cartridge mounting space 73 is positioned leftward of its corresponding cartridge replacement hole 12, as shown in FIG. 7. Therefore, the toner cartridge 11 inserted into the drawer frame 5 through the cartridge replacement hole 12 enters into the cartridge mounting space 73. When the toner cartridge 11 is accommodated within the cartridge mounting space 73, mounting of the toner cartridge 11 in the drawer frame 5 (the cartridge mounting space 73) is completed.

When the toner cartridge 11 has been mounted within the cartridge mounting space 73, the agitator coupling 171 of the toner cartridge 11 is coupled to the developing-device coupling 88 (see FIG. 8) of the developing device 9, as shown in FIG. 6. Therefore, the driving force inputted to the developing gear 90 can be transmitted to the agitator shaft 170 via the developing-device coupling 88 and the agitator coupling 171.

When the toner cartridge 11 is not mounted in the cartridge mounting space 73, the communication port 91 of the developing device 9 is closed by the developing-device shutter 92, as shown in FIG. 10. Likewise, the toner discharging outlet 167 of the toner cartridge 11 is also closed by the cartridge shutter 168 when the toner cartridge 11 is removed from the cartridge mounting space 73. When the toner cartridge 11 is accommodated in the cartridge mounting space 73, the developing-device shutter 92 and the cartridge shutter 168 are positioned such that both developing-device shutter 92 and cartridge shutter 168 overlap with each other. Subsequently, due to a shutter driving mechanism (not shown), the developing-device shutter 92 and the cartridge shutter 168 are integrally moved to open the communication port 91 and the toner discharging outlet 167 respectively, as shown in FIGS. 5, 9 and 14. As a result, the developing chamber 72 and the toner accommodation portion 163 are permitted to be in fluid communication with each other via the communication port 91 and the toner discharging outlet 167.

As to the toner cartridge 11K, while the toner cartridge 11K is being mounted in the corresponding cartridge mounting space 73, the receiving port shutter 186 of the cartridge-side conveying unit 181 is brought into abutment with a right end face of the conveying chamber outer wall 142 of the joint conveying unit 141, as shown in FIG. 6. As the toner cartridge 11K is further inserted leftward, the main body portion 182 of the cartridge-side conveying unit 181 enters into the waste toner conveying chamber 143 of the joint conveying unit 141. As a result, the receiving port shutter 186 (at its closing position) is moved rightward against the biasing force of the coil spring 188. The receiving port shutter 186 is therefore moved toward the open position, and is finally positioned at the open position when the mounting of the toner cartridge 11K into the cartridge mounting space 73 is completed.

In the meantime, while the main body portion 182 of the cartridge-side conveying unit 181 moves leftward within the waste toner conveying chamber 143, the main body portion 182 is brought into contact with a right end face of the communication chamber shutter 145, which is in its shut-down position. Subsequently, as the main body portion 182 is further inserted leftward, the communication chamber shutter 145 is pushed leftward by the main body portion 182, against the biasing force of the coil spring 151, toward the communication position. When the mounting of the toner cartridge 11K in the cartridge mounting space 73 is completed, the communication chamber shutter 145 is placed at the communication position.

When the communication chamber shutter 145 is in the communication position, the waste toner conveying chamber 143 and the communication chamber 144 are in communication with each other, which means that the waste toner conveying chamber 114 of the belt cleaner 13 and the waste toner conveying chamber 143 are in communication with each other via the communication chamber 144. At the same time, since the receiving port shutter 186 is in the open position, the waste toner receiving port 185 is opened. Since the waste toner receiving port 185 opposes the communication chamber 144 from below, the communication chamber 144 and the waste toner conveying chamber 184 of the cartridge-side conveying unit 181 are in communication with each other via the waste toner receiving port 185. The waste toner conveying chamber 184 is in communication with the connected portion 183 (internal space of the connected portion 183) via the inner communication port 197, while the internal space of the connected portion 183 is in communication with the waste toner accommodation portion 164 of the toner cartridge 11K (see FIGS. 14 and 15). In other words, the waste toner conveying chamber 114 of the belt cleaner 13 and the waste toner accommodation portion 164 of the toner cartridge 11K are in communication with each other via the waste toner conveying chamber 143, the communication chamber 144, the waste toner receiving port 185, the waste toner conveying chamber 184, the inner communication port 197 and the internal space of the connected portion 183.

When the toner cartridge 11K is mounted within the cartridge mounting space 73, the cartridge coupling 192 of the cartridge-side conveying unit 181 is coupled to the cleaner coupling 148 of the joint conveying unit 141, as shown in FIG. 6. Therefore, the driving force inputted to the gear 150 can be transmitted to the auger shaft 190 via the rotational shaft rotational shaft 149, the cleaner coupling 148 and the cartridge coupling 192.

For removing the toner cartridge 11 from the cartridge mounting space 73 of the developing device 9, the user performs operations opposite to those performed for mounting the toner cartridge 11.

In this way, all the toner cartridges 11 including the toner cartridge 11K can be inserted into and removed from the respective cartridge mounting spaces 73 from rightward thereof via the cartridge replacement holes 12. Further, as described earlier, the toner cartridges 11 for yellow, cyan and magenta (other than the toner cartridge 11K) are also mountable in the drawer frame 5 from above, integrally with the respective process units 6, in a state where each toner cartridge 11 is accommodated within the corresponding cartridge mounting space 73.

6. Supplying Toner

Once the toner cartridge 11 has been accommodated within the cartridge mounting space 73, the drawer unit 3 is pushed back into the main casing 2 to be in the accommodated position. When the front cover 4 is closed, toner stored within the toner cartridge 11 is started to be supplied to the developing device 9 of the corresponding process unit 6.

More specifically, referring to FIGS. 5, 9 and 14, the agitator shaft 170 starts to rotate in a counterclockwise direction in FIG. 5 due to the driving force inputted to the agitator shaft 170. In accordance with rotation of the agitator shaft 170, the agitator 169 also rotates in the counterclockwise direction in FIG. 5, while being slidingly in contact with an inner surface defining the toner accommodation portion 163. Due to the rotation of the agitator 169, toner stored in the vicinity of the toner discharging outlet 167 is moved (pushed) toward the toner discharging outlet 167, and is discharged out of the toner accommodation portion 163 through the toner discharging outlet 167. The discharged toner then flows into the developing chamber 72 via the communication port 91. In this way, toner within the toner accommodation portion 163 of the toner cartridge 11 is supplied to the developing chamber 72 of the developing device 9.

The toner flown into the developing chamber 72 is then supplied onto the developing roller 75 (the developing roller main body 76) via the supply roller 78 (supply roller main body 79), due to rotation of the supply roller 78. As the developing roller 75 rotates, the toner carried on the developing roller 75 then enters between the developing roller 75 and the thickness regulating blade 83, and is borne on the developing roller 75 as a thin layer of uniform thickness.

During image formation, the developing device 9 is positioned in the neighboring position (shown in FIG. 1), whereby the developing roller 75 is in contact with the photosensitive drum 7. Therefore, in accordance with rotation of the developing roller 75 and the photosensitive drum 7, the toner borne on the developing roller 75 is supplied to the photosensitive drum 7, thereby developing the electrostatic latent image formed on the photosensitive drum 7 into the toner image.

When image formation is not performed, the developing device 9 is in the separated position (shown in FIG. 2). The developing roller 75 is therefore in separation from the photosensitive drum 7.

7. Collecting Waste Toner

Toner supplied to the surface of the photosensitive drum 7 may sometimes remain deposited thereon without being transferred to the sheets. Such toner is called as waste toner.

Referring to FIG. 1, a cleaning bias is applied to each drum cleaner 10 during image formation. Due to this application of the cleaning bias, the waste toner deposited on the surface of the photosensitive drum 7 is transferred to the cleaning roller main body 101 of the drum cleaner 10 so that the waste toner can be temporarily stored on the cleaning roller main body 101.

After image formation is ended and before next image formation is carried out, a bias having a polarity opposite to that of the cleaning bias is applied to the drum cleaner 10 so that the waste toner retained on the cleaning roller main body 101 can be transferred back to the surface of the photosensitive drum 7. When another bias is applied to each primary transfer roller 18, the waste toner back to each photosensitive drum 7 is then transferred to the intermediate belt 15.

Likewise, toner supplied to the surface of the photosensitive drum 7 from the developing roller 75 may sometimes be transferred to the intermediate belt 15 during image formation. Such toner is also waste toner.

The waste toner deposited on the intermediate belt 15 is collected by the belt cleaner 13. More specifically, referring to FIG. 5, a primary cleaning bias is applied to the primary belt cleaning roller 116 and a secondary cleaning bias is applied to the secondary belt cleaning roller 117. The waste toner on the intermediate belt 15 is transferred to the roller main body 118 of the primary belt cleaning roller 116 when confronting the roller main body 118 as the intermediate belt 15 circularly moves. The waste toner on the roller main body 118 is then transferred to the roller main body 122 of the secondary belt cleaning roller 117. The waste toner on the roller main body 122 is then scraped away therefrom by the scraper 126 when opposing the scraper 126. The waste toner is then received at the waste toner conveying chamber 114.

Referring to FIG. 6, within the waste toner conveying chamber 114, the auger 127 is rotating. The waste toner flowing into the waste toner conveying chamber 114 is then conveyed, due to the rotation of the auger 127, toward the position where the first and second spiral portions of the auger screw 129 meet (the position leftward of a center of the waste toner conveying chamber 114 in the left-to-right direction). The waste toner then falls, due to its self-weight, through the communication chamber 144 and into the waste toner conveying chamber 184 of the cartridge-side conveying unit 181 via the waste toner receiving port 185. In other words, the joint conveying unit 141 drops the waste toner conveyed by the auger 127, by using the self-weight of the waste toner, through the communication chamber 144 and into the waste toner conveying chamber 184 of the cartridge-side conveying unit 181 via the waste toner receiving port 185.

Referring to FIG. 17, within the waste toner conveying chamber 184, the auger 189 is rotating due to the driving force inputted to the auger shaft 190. The waste toner conveyed to the waste toner conveying chamber 184 is then conveyed rightward by the rotating auger 189. The waste toner reaching the right end of the waste toner conveying chamber 184 then falls, due to its self-weight, into the waste toner accommodation portion 164 of the toner cartridge 11 via the inner communication port 197 and the connected portion 183.

8. Advantageous Effects of the Invention 8-1. First Advantageous Effect

As above described, toner is supplied to each photosensitive drum 7 from the developing roller 75 held to the corresponding developing device 9. Above the photosensitive drums 7, the endless intermediate belt 15 is disposed so as to oppose the photosensitive drums 7. Therefore, toner is transferred to and deposited on the intermediate belt 15. Such toner deposited on the intermediate belt 15 for purposes other than image formation is waste toner, which should be removed and disposed.

In order to remove and collect waste toner from the intermediate belt 15, the belt cleaner 13 is provided. The waste toner collected by the belt cleaner 13 is conveyed to the waste toner accommodation portion 164 via the auger 127, the joint conveying unit 141 and the cartridge-side conveying unit 181. The auger 127, the joint conveying unit 141 and the cartridge-side conveying unit 181 constitute an example of a conveying mechanism.

The developing device 9 can accommodate therein the toner cartridge 11 having the toner accommodation portion 163 that stores toner therein. The toner accommodation portion 163 of the toner cartridge 11K is integrally formed with the waste toner accommodation portion 164. The waste toner accommodation portion 164 is provided such that the waste toner accommodation portion 164 is movable relative to the cartridge-side conveying unit 181.

Hence, while the waste toner accommodation portion 164 is integrally provided with the toner accommodation portion 163, the toner accommodation portion 163 and the waste toner accommodation portion 164 can be moved integrally with each other, thereby moving the developing roller 75 relative to the photosensitive drum 6. As a result, the developing roller 75 can be suitably positioned relative to the photosensitive drum 7 even after the process unit 6 and the toner cartridge 11K integrally including the toner accommodation portion 163 and the waste toner accommodation portion 164 have been mounted in the main casing 2. Further, since the developing roller 75 can be separated from the photosensitive drum 7 when image formation is not performed, deterioration of the developing roller 75 and the photosensitive drum 7 can be prevented.

Further, since the toner accommodation portion 163 and the waste toner accommodation portion 164 are integrally formed, the waste toner accommodation portion 164 can be replaced at least as frequently as the toner accommodation portion 163 is replaced. Therefore, the waste toner accommodation portion 164 is not necessary to have a relatively large capacity. Such compact waste toner accommodation portion 164 can also lead to downsizing of the color printer 1.

8-2. Second Advantageous Effect

The developing devices 9 and the belt cleaner 13 are supported to the drawer frame 5. The drawer frame 5 is movable between the accommodated position and the pulled-out position. When the drawer frame 5 is in the pulled-out position, the drawer frame 5 does not oppose the intermediate belt 15. In other words, the aperture 500 of the drawer frame 5 is open upward when the drawer frame 5 is in the pulled-out position. When the drawer frame 5 is in the pulled-out position, the developing devices 9 and the belt cleaner 13 are exposed outside of the main casing 2. Therefore, maintenance of the developing devices 9 and the belt cleaner 13 can be performed easily.

The belt cleaner 13 is fixed to the drawer frame 5 such that the belt cleaner 13 is positioned downstream of the developing devices 9 in a pulled-out direction in which the drawer frame 5 is pulled out from the main casing 2 (i.e., the belt cleaner 13 is positioned frontward of the developing devices 9). Therefore, the user can perform maintenance on the belt cleaner 13 when the drawer frame 5 is slightly moved frontward from its accommodated position. This arrangement of the belt cleaner 13 and the developing devices 9 is particularly effective in performing maintenance of the belt cleaner 13.

8-3. Third Advantageous Effect

The waste toner accommodation portion 164 is formed with the cylindrical-shaped connecting portion 176, while the cartridge-side conveying unit 181 is formed with the cylindrical-shaped connected portion 183. The connected portion 183 is inserted into the connecting portion 176 such that the connected portion 183 is movable relative to the connecting portion 176. Therefore, even when the waste toner accommodation portion 164 is moved relative to the cartridge-side conveying unit 181, connection between the connecting portion 176 and the connected portion 183 can be secured.

8-4. Fourth Advantageous Effect

The auger 127 is configured to convey the waste toner collected by the belt cleaner 13 toward the position leftward of the center of the auger shaft 128 in the left-to-right direction within the waste toner conveying chamber 114, the position (a prescribed position) being a meeting point of the first and second spiral portions of the auger screw 129. Therefore, the waste toner is conveyed both rightward and leftward in the left-to-right direction, which is parallel to an axial direction in which the developing roller shaft 77 of the developing roller 75 extends. The waste toner then falls by its self-weight and reaches the waste toner conveying chamber 143 via the joint conveying unit 141.

8-5. Fifth Advantageous Effect

The joint conveying unit 141 drops the waste toner conveyed by the auger 127 by using the self-weight of the waste toner. The cartridge-side conveying unit 181 is configured to convey the waste toner flowing thereinto from the joint conveying unit 141 toward the connected portion 183 such that the waste toner is conveyed solely rightward in the axial direction (in the left-to-right direction). In this way, the waste toner is reliably conveyed to the waste toner accommodation portion 164 by the joint conveying unit 141 and the cartridge-side conveying unit 181.

8-6. Sixth Advantageous Effect

The photosensitive drums 7 are supported to the drawer frame 5. The toner accommodation portion 163, which is provided integrally with the waste toner accommodation portion 164, is also provided integrally with the cartridge-side conveying section 181 in the toner cartridge 11K. The cartridge-side conveying unit 181 which is integral with the waste toner accommodation portion 164 and the toner accommodation portion 163 is detachable with respect to the drawer frame 5 in the axial direction. When the toner accommodation portion 163 is mounted in the drawer frame 5, the cartridge-side conveying unit 181 is connected to the joint conveying unit 141 in the axial direction. Therefore, upon completion of mounting of the toner accommodation portion 163 (toner cartridge 11K) on the drawer frame 5, connection between the joint conveying unit 141 and the cartridge-side conveying unit 181 can also be achieved.

8-7. Seventh Advantageous Effect

The joint conveying unit 141 includes the conveying chamber outer wall 142 and the communication chamber shutter 145 that is movable relative to the conveying chamber outer wall 142 in the axial direction. The conveying chamber outer wall 142 is formed with the communication chamber 144 that receives the waste toner conveyed by the auger 127. When the cartridge-side conveying unit 181 is not connected to the joint conveying unit 141, the communication chamber 144 is closed by the communication chamber shutter 145. When the cartridge-side conveying unit 181 is connected to the joint conveying unit 141, the communication chamber shutter 145 moves relative to the conveying chamber outer wall 142 in the axial direction, opening the communication chamber 144.

Therefore, when the cartridge-side conveying unit 181 and the joint conveying unit 141 are not connected to each other, leaking of the waste toner from the joint conveying unit 141 can be prevented. When the cartridge-side conveying unit 181 is connected to the joint conveying unit 141, the waste toner can be conveyed from the joint conveying unit 141 to the cartridge-side conveying unit 181.

8-8. Eighth Advantageous Effect

The developing device 9 is pivotally movable about the pivot shaft 94 such that the developing device 9 is movable between the neighboring position where the developing roller 75 is positioned relatively close to the corresponding photosensitive drum 7 and the separated position where the developing roller 75 is positioned relatively in separation from the corresponding photosensitive drum 7.

The waste toner accommodation portion 164 is provided with the connecting portion 176 that is connectable to the joint conveying unit 141 such that the connecting portion 176 is movable relative to the joint conveying unit 141. In other words, the waste toner accommodation portion 164 and the joint conveying unit 141 are movable relative to each other via the connecting portion 176 provided on the waste toner accommodation portion 164. Therefore, the connection between the waste toner accommodation portion 164 and the joint conveying unit 141 does not interfere with a pivotal movement of the developing device 9 that supports the toner accommodation portion 163 and the waste toner accommodation portion 164. As a result, the developing device 9 is allowed to move together with the waste toner accommodation portion 164, which means that the developing roller 75 is allowed to move relative to the photosensitive drum 7.

Accordingly, the developing roller 75 can be suitably positioned relative to the photosensitive drum 7 even after the process unit 6 and the toner cartridge 11K integrally including the toner accommodation portion 163 and the waste toner accommodation portion 164 have been mounted in the main casing 2. Further, since the developing roller 75 can be separated from the photosensitive drum 7 when image formation is not performed, deterioration of the developing roller 75 and the photosensitive drum 7 can be prevented.

8-9. Ninth Advantageous Effect

Further, the connecting portion 176 has a circular arc shape in vertical cross-section whose center is coincident with the axis of the pivot shaft 94. Therefore, while the developing device 9 is pivotally moved about the pivot shaft 94, the connecting portion 176 and the joint conveying unit 141 can smoothly move relative to each other. Pivotal movement of the developing device 9 is therefore facilitated.

8-10. Tenth Advantageous Effect

The connecting portion 176 is formed at a position adjacent to the center of the casing 161 (the developing device 9) in the axial direction. Hence, even when a certain resistance acts on the developing device 9 during icircular arc shapts pivotal movement, the developing roller 75 can be biased toward the photosensitive drum 7 in a balanced manner in the axial direction.

9. Modifications

Various modifications to the above-described embodiment are conceivable. Hereinafter, modifications of the embodiment will be described with FIG. reference to FIGS. 19 and 20 wherein like parts and components are designated by the same reference numerals as those of the embodiment to avoid duplicating description.

9-1. First Modification

Figure 19:
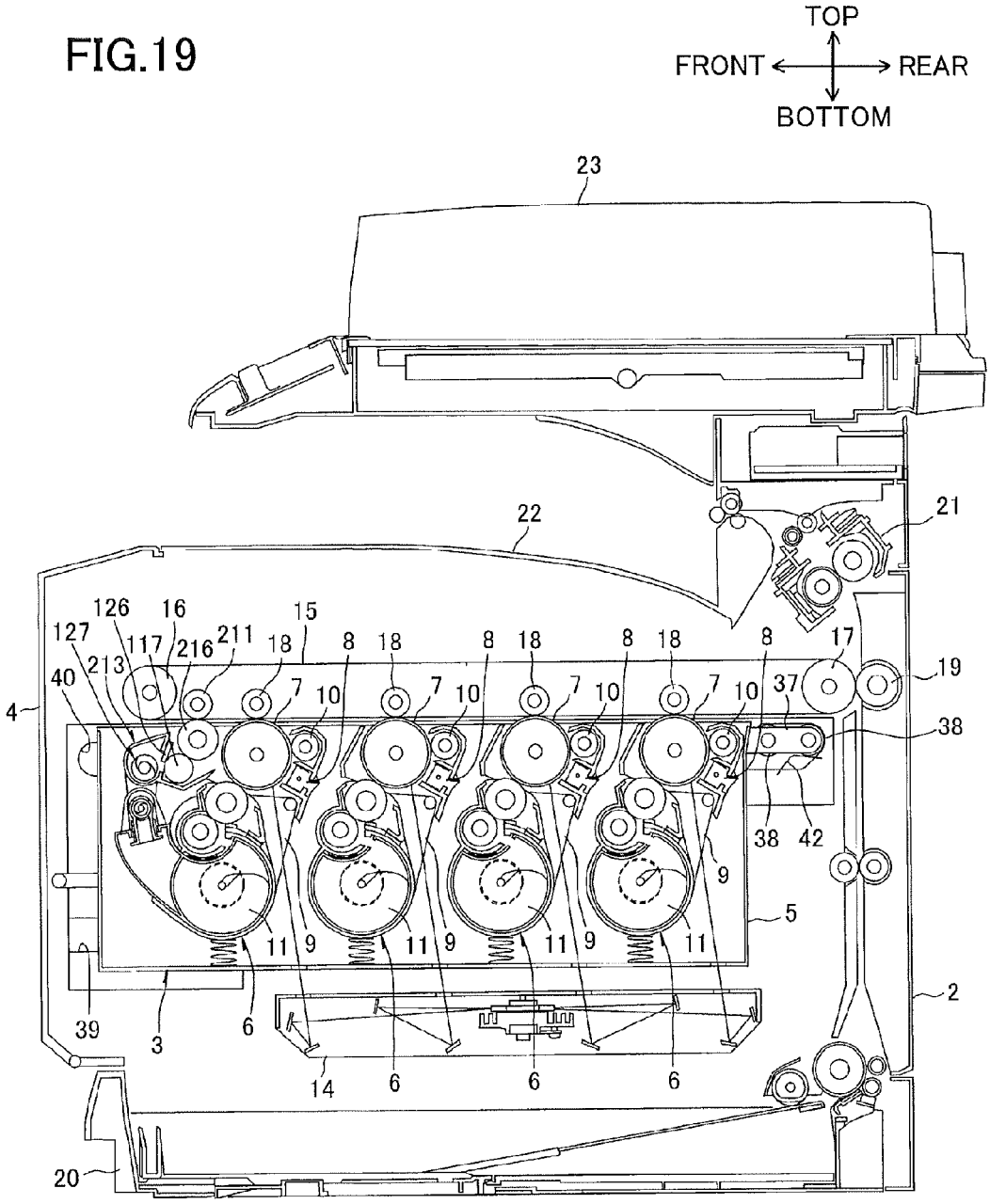
FIG. 19 is a cross-sectional view of a color printer according to a first modification of the embodiment.

FIG. 19 shows a belt cleaner 213 according to a first modification of the embodiment.

The belt cleaner 213 has a primary belt cleaning roller 216 that is in contact with a front end portion of the flat-plate portion (lower portion) of the intermediate belt 15. In the first modification, a back-up roller 211 is disposed within the internal space of the intermediate belt 15 such that the back-up roller 211 opposes the primary belt cleaning roller 216 via the flat-plate portion of the intermediate belt 15.

9-2. Second Modification

Figure 20:
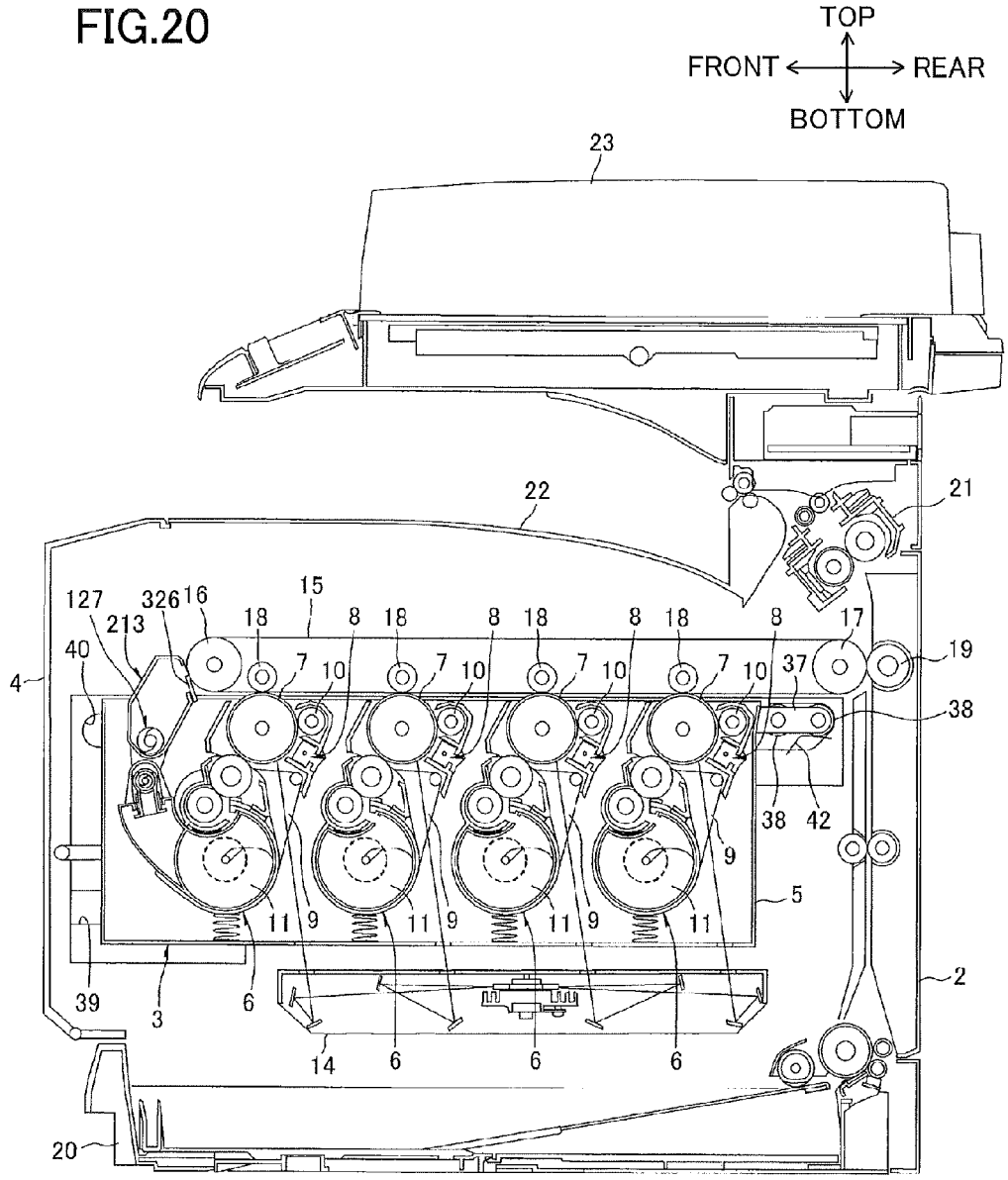
FIG. 20 is a cross-sectional view of a color printer according to a second modification of the embodiment.

FIG. 20 shows a belt cleaner 313 according to a second modification of the embodiment.

In the belt cleaner 313, the primary belt cleaning roller 116 and the secondary belt cleaning roller 117 of the embodiment are not provided. Instead, the belt cleaner 313 has a scraper 326 whose tip end portion is in direct contact with the intermediate belt 15.

9-3. Third Modification

The cylindrical-shaped connected portion 183 may be formed of an elastic tube. The connected portion 183 may be fixed to the connecting portion 176 and the inner communication port 197 of the main body portion 182 by way of adhesive bonding, for example.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a photosensitive drum;

an endless belt confronting the photosensitive drum;

a developing unit comprising a developer accommodation portion that is configured to accommodate developer, and a developing roller that is rotatably provided and supplies the photosensitive drum with the developer;

a collecting unit configured to remove waste developer to be discarded from the endless belt and to collect the waste developer;

a waste developer accommodation portion provided integrally with the developer accommodation portion and configured to accommodate the waste developer collected by the collecting unit; and a conveying mechanism configured to be connected to both the waste developer accommodation portion and the collecting unit and to convey the waste developer from the collecting unit to the waste developer accommodation portion, wherein the waste developer accommodation portion is movable relative to the conveying mechanism while maintaining connection between the waste developer accommodation portion and the conveying mechanism.

2. An image forming apparatus comprising:

a photosensitive drum;

an endless belt confronting the photosensitive drum from above;

a developing unit comprising a developer accommodation portion that is configured to accommodate developer, and a developing roller that is rotatably provided and supplies the photosensitive drum with the developer;

a collecting unit configured to remove waste developer to be discarded from the endless belt and to collect the waste developer;

a waste developer accommodation portion provided integrally with the developer accommodation portion and configured to accommodate the waste developer collected by the collecting unit; and a conveying mechanism configured to be connected to both the waste developer accommodation portion and the collecting unit and to convey the waste developer from the collecting unit to the waste developer accommodation portion, wherein the waste developer accommodation portion is movable relative to the conveying mechanism.

3. The image forming apparatus according to claim 1, further comprising:

a main casing;

a retaining member retaining the developing unit and the collecting unit, and configured to move between an accommodated position where the retaining member is accommodated in the main casing and a pulled-out position where the retaining member is pulled out from the main casing, and wherein the collecting unit is positioned downstream of the developing unit in a direction in which the retaining member is moved from the accommodated position to the pulled-out position.

4. The image forming apparatus according to claim 3, wherein the retaining member has an opened part that is opened upward, the opened part confronting the endless belt when the retaining member is in the accommodated position, the opened part failing to confront the endless belt when the retaining member is in the pulled-out position.

5. The image forming apparatus according to claim 4, wherein the opened part is opened upward.

6. The image forming apparatus according to claim 1, wherein the waste developer accommodation portion includes a connecting portion that is cylindrically shaped, wherein the conveying mechanism includes a connected portion that is cylindrically shaped and is inserted into the connecting portion such that the connected portion is movable relative to the connecting portion.

7. The image forming apparatus according to claim 6, wherein the developing roller is configured to rotate about an axis extending in an axial direction, wherein the conveying mechanism comprises a first conveying member that conveys the waste toner collected by the collecting unit in the axial direction, the conveying mechanism being configured to drop the waste toner conveyed by the first conveying member by using self-weight of the waste toner.

8. The image forming apparatus according to claim 7, wherein the conveying mechanism comprises a second conveying member that drops the waste toner conveyed by the first conveying member by the self-weigh and a third conveying member that conveys the waste toner conveyed by the second conveying member to the connected portion in the axial direction.

9. The image forming apparatus according to claim 8, further comprising a retaining member retaining the photosensitive drum, and wherein the developer accommodation portion, which is provided integrally with the waste developer accommodation portion, is provided integrally with the third conveying member and is detachable with respect to the retaining member in the axial direction, wherein the third conveying member is connected to the second conveying member along the axial direction in a state that the developer accommodation portion is mounted in the retaining member.

10. The image forming apparatus according to claim 9, wherein the second conveying member comprises a cylindrical portion extending in the axial direction, and a shutter movable relative to the cylindrical portion in the axial direction, the cylindrical portion being formed with an opening that receives the waster developer conveyed by the first conveying member, wherein the opening is closed by the shutter when the third conveying member is not connected to the second conveying member, and the shutter is moved relative to cylindrical portion in the axial direction to open the opening when the third conveying member is connected to the second conveying member.

11. The image forming apparatus according to claim 1, wherein the developing roller is configured to rotate about a rotational axis extending in an axial direction, wherein the developing unit is pivotally movable about a pivotal axis parallel to the rotational axis such that the developing unit is moved between a neighboring position where the developing roller is positioned relatively close to the photosensitive drum and a separated position where the developing roller is positioned relatively in separation from the photosensitive drum, wherein the waste developer accommodation portion includes a connecting portion that is connected to the conveying mechanism to be movable relative to the conveying mechanism.

12. The image forming apparatus according to claim 11, wherein the connecting portion has a circular arc shape whose center is coincident with the pivotal axis.

13. The image forming apparatus according to claim 11, wherein the developing unit is disposed below the endless belt, wherein the conveying mechanism comprises a first conveying member that conveys the waste toner collected by the collecting unit to a prescribed position in the axial direction, the conveying mechanism being configured to drop the waste toner conveyed by the first conveying member by using self-weight of the waste toner.

14. The image forming apparatus according to claim 11, wherein the connecting portion is disposed at a center of the developing unit in the axial direction.

15. An image forming apparatus comprising:

a target member used for waste developer recovery;

a developing unit comprising a developer accommodation portion that is configured to accommodate developer, and a developing roller that is rotatably provided about a rotational axis extending in an axial direction and bears the developer thereon, the developing unit being pivotally movable about a pivotal axis parallel to the rotational axis;

a collecting unit configured to remove waste developer to be discarded from the target member and to collect the waste developer;

a waste developer accommodation portion provided integrally with the developer accommodation portion and configured to accommodate the waste developer collected by the collecting unit; and a conveying mechanism configured to be connected to both the waste developer accommodation portion and the collecting unit and to convey the waste developer from the collecting unit to the waste toner accommodation portion, wherein the waste developer accommodation portion is provided with a connecting portion that is connected to the conveying mechanism to be movable relative to the conveying mechanism.

16. A cartridge configured to be detachably mounted on a developing unit provided on an image forming apparatus, the image forming apparatus including an endless belt and a collecting unit configured to remove waste developer to be discarded from the endless belt and to collect the waste developer, the cartridge comprising:

a developer accommodation portion configured to accommodate developer;

a waste developer accommodation portion provided integrally with the developer accommodation portion and configured to accommodate the waste developer collected by the collecting unit; and a conveying mechanism configured to be connected to both the waste developer accommodation portion and the collecting unit and to convey the waste developer from the collecting unit to the waste toner accommodation portion, wherein the waste developer accommodation portion is provided with a connecting portion, the connecting portion being connected to the conveying mechanism to be movable relative to the conveying mechanism such that the connecting portion is rotatable in a state that the developer accommodation portion and the waste developer accommodation portion are mounted on the developing unit.

* * * * *